US008905220B2

(12) United States Patent
Yokote

(10) Patent No.: US 8,905,220 B2
(45) Date of Patent: Dec. 9, 2014

(54) DRAWER DEVICE AND MEDIUM TRANSACTION DEVICE

(71) Applicant: Oki Electric Industry Co., Ltd., Tokyo (JP)

(72) Inventor: Takamoto Yokote, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/002,111

(22) PCT Filed: Mar. 4, 2013

(86) PCT No.: PCT/JP2013/055878

§ 371 (c)(1),
(2), (4) Date: Aug. 28, 2013

(87) PCT Pub. No.: WO2013/146113

PCT Pub. Date: Oct. 3, 2013

(65) Prior Publication Data

US 2014/0069768 A1 Mar. 13, 2014

(30) Foreign Application Priority Data

Mar. 29, 2012 (JP) ..... 2012-076490

(51) Int. Cl.
*G07F 9/10* (2006.01)
*G07D 11/00* (2006.01)

(52) U.S. Cl.
CPC ..... *G07D 11/0048* (2013.01); *G07D 11/081* (2013.01); *G07D 11/0036* (2013.01); *G07D 11/0003* (2013.01)
USPC ..... 194/350

(58) Field of Classification Search
CPC ..... G07D 11/0048; G07D 2211/00
USPC ..... 194/200, 350, 353; 902/9; 235/379; 209/534; 109/3, 39, 43, 47, 52; 312/215, 222, 330.1, 330; 292/DIG. 46
See application file for complete search history.

(56) References Cited

U.S. PATENT DOCUMENTS 5,344,226 A * 9/1994 Lee ..... 312/334.47
2012/0255829 A1 10/2012 Togiya

FOREIGN PATENT DOCUMENTS

| | | | |
|---|---|---|---|
| JP | H05-49755 | U | 6/1993 |
| JP | H06-31571 | Y | 4/1994 |
| JP | H07-122371 | B2 | 12/1995 |
| JP | 2011-118699 | A | 6/2011 |

* cited by examiner

*Primary Examiner* — Mark Beauchaine
(74) *Attorney, Agent, or Firm* — Rabin & Berdo, P.C.

(57) ABSTRACT

A banknote deposit and withdrawal machine uses an interlock switch to detect whether or not a lower unit has been pulled out from a safe housing, uses a lock sensor to detect at least two states among a locked state, a half-locked state, and a pulled-out state, and uses a banknote control unit to distinguish between the three states of the locked state, the half-locked state, and the pulled-out state on the basis of the result of detection by the interlock switch and the result of detection by the lock sensor.

8 Claims, 29 Drawing Sheets

FIG.9

| STATE | LOCK SENSOR | INTERLOCK SWITCH |
|---|---|---|
| LOCKED STATE | DARK STATE | ON |
| HALF-LOCKED STATE | LIGHT STATE | ON |
| PULLED-OUT STATE | DARK STATE | OFF |
| FAILURE (SHORT CIRCUIT) | LIGHT STATE | ——— |
| FAILURE (DISCONNECTION) | DARK STATE | ——— |

| STATE | LOCK SENSOR | INTERLOCK SWITCH |
|---|---|---|
| LOCKED STATE | LIGHT STATE | ON |
| HALF-LOCKED STATE | DARK STATE | ON |
| PULLED-OUT STATE | DARK STATE | OFF |
| FAILURE (SHORT CIRCUIT) | LIGHT STATE | ——— |
| FAILURE (DISCONNECTION) | DARK STATE | ——— |

FIG.17

| STATE | LOCK SENSOR | INTERLOCK SWITCH |
|---|---|---|
| LOCKED STATE | DARK STATE | ON |
| HALF-LOCKED STATE | LIGHT STATE | ON |
| PULLED-OUT STATE | LIGHT STATE | OFF |
| FAILURE (SHORT CIRCUIT) | LIGHT STATE | ———— |
| FAILURE (DISCONNECTION) | DARK STATE | ———— |

DRAWER DEVICE AND MEDIUM TRANSACTION DEVICE

TECHNICAL FIELD

The present invention relates to a drawer device and a medium transaction device, and is suitably applied to an automatic teller machine (ATM) or the like into which a medium such as banknotes, for example, is deposited and which performs desired transactions.

BACKGROUND ART

Conventionally, automatic teller machines or the like used in financial institutions and so forth are configured, for example, to allow a customer to deposit cash such as banknotes and coins and to dispense cash to the customer in accordance with the details of the transaction with the customer.

As an automatic teller machine, for example, there has been proposed an automatic teller machine having a banknote deposit and withdrawal opening that accepts banknotes from, and dispenses banknotes to, a customer, an identification unit that identifies the denomination and authenticity of banknotes that have been deposited, a temporary holding unit that temporarily holds banknotes that have been deposited, and denomination cassettes that store banknotes by denomination.

When, in a deposit transaction, a customer deposits banknotes into the banknote deposit and withdrawal opening, the automatic teller machine conveys the deposited banknotes to the identification unit and performs an identification. The automatic teller machine temporarily holds, in the temporary holding unit, banknotes identified as normal banknotes and returns, to the banknote deposit and withdrawal opening, banknotes identified as banknotes that should be not transacted, which the automatic teller machine returns to the customer. Then, when the amount of the deposit is finalized by the customer, the automatic teller machine has the identification unit re-identify the denominations of the banknotes held in the temporary holding unit. Then, the automatic teller machine stores the banknotes in the denomination cassettes in accordance with the denominations identified by the re-identification.

Automatic teller machines have a robust housing in which a drawer having the plural denomination cassettes stored therein is disposed, to thereby protect the banknotes and so forth stored inside the denomination cassettes. When maintenance work or the like on the parts of the automatic teller machine is performed, it is necessary to allow a clerk-in-charge at the financial institution or a maintenance worker to access the inside of the automatic teller machine.

Therefore, among automatic teller machines, there has been proposed a banknote deposit and withdrawal machine in which the front surface and the back surface of the housing are configured by doors that can be opened and closed and which is configured in such a way that, in a state in which the doors have been opened, the drawer can be pulled out to the outside by a predetermined slide mechanism or the like (e.g., see patent citation 1: Japanese Utility Model Application Publication (JP-Y) No. H06-31571 (FIG. 1)).

DISCLOSURE OF INVENTION

Technical Problem

In such automatic teller machines, in a case where the drawer has been pushed into the housing and appropriately positioned in a predetermined storage position, the banknotes are normally conveyed on a conveyance path inside the automatic teller machine.

However, there have been cases where, even if it is determined that the drawer is positioned in the storage position in the housing, in actuality the drawer is not properly positioned in the storage position.

In such cases, the automatic teller machine cannot normally convey the banknotes because the banknote conveyance path is not appropriately configured in the automatic teller machine. As a result, there has been the concern that a banknote jam or the like will occur and that the reliability of the device will drop.

The present invention has been made in consideration of the above points and attempts to provide a drawer device and a medium transaction device with which reliability can be markedly raised.

Solution to Problem

In order to solve this problem, a drawer device of the present invention includes: a housing having a predetermined space inside; a drawer disposed in such a way that it can be stored in a predetermined storage position in the housing and can be pulled out to the outside of the housing; an interlock switch that detects whether or not the drawer has been pulled out from the housing; a lock portion that locks the drawer in the storage position and releases the lock to enable the drawer to be pulled out from the housing; a lock detection sensor that is disposed in the neighborhood of the lock portion and detects at least two states among a locked state in which the lock portion is locking the drawer, a half-locked state in which the lock portion is incompletely locking the drawer, and a pulled-out state in which the lock of the lock portion is released; and a control unit that distinguishes between the locked state, the half-locked state, and the pulled-out state on the basis of the result of detection by the interlock switch and the result of detection by the lock detection sensor.

The drawer device can detect the states of the drawer with respect to the housing and can raise the positional precision of the drawer with respect to the housing.

Further, a medium transaction device of the present invention includes: a housing having a predetermined space inside; a reception unit that is disposed in the housing and receives transactions relating to a leaf-like medium; a conveyance unit that is disposed in the housing and conveys the medium received by the reception unit; a drawer disposed in such a way that it can be stored in a predetermined storage position in the housing and can be pulled out to the outside of the housing; an interlock switch that detects whether or not the drawer has been pulled out from the housing; a lock portion that locks the drawer in the storage position and releases the lock to enable the drawer to be pulled out from the housing; a lock detection sensor that is disposed in the neighborhood of the lock portion and detects at least two states among a locked state in which the lock portion is locking the drawer, a half-locked state in which the lock portion is incompletely locking the drawer, and a pulled-out state in which the lock of the lock portion is released; and a control unit that distinguishes between the locked state, the half-locked state, and the pulled-out state on the basis of the result of detection by the interlock switch and the result of detection by the lock detection sensor.

The medium transaction device can detect the states of the drawer with respect to the housing and can raise the positional precision of the drawer with respect to the housing.

Advantageous Effects of Invention

According to the present invention, the present invention can detect the states of the drawer with respect to the housing and can raise the positional precision of the drawer with respect to the housing. In this way, the present invention can realize a drawer device and a medium transaction device with which reliability can be markedly raised.

BRIEF DESCRIPTION OF DRAWINGS

FIG. 9 is a schematic diagram showing states of a lock sensor and interlock switch according to the first embodiment;

FIG. 17 is a schematic diagram showing states of the lock sensor and interlock switch according to the third and fourth embodiments;

BEST MODES FOR CARRYING OUT THE INVENTION

Modes for carrying out the invention (hereinafter called embodiments) will be described below using the drawings.

<1. First Embodiment>

[1-1. Overall Configuration of Automatic Teller Machine]

Figure 1:
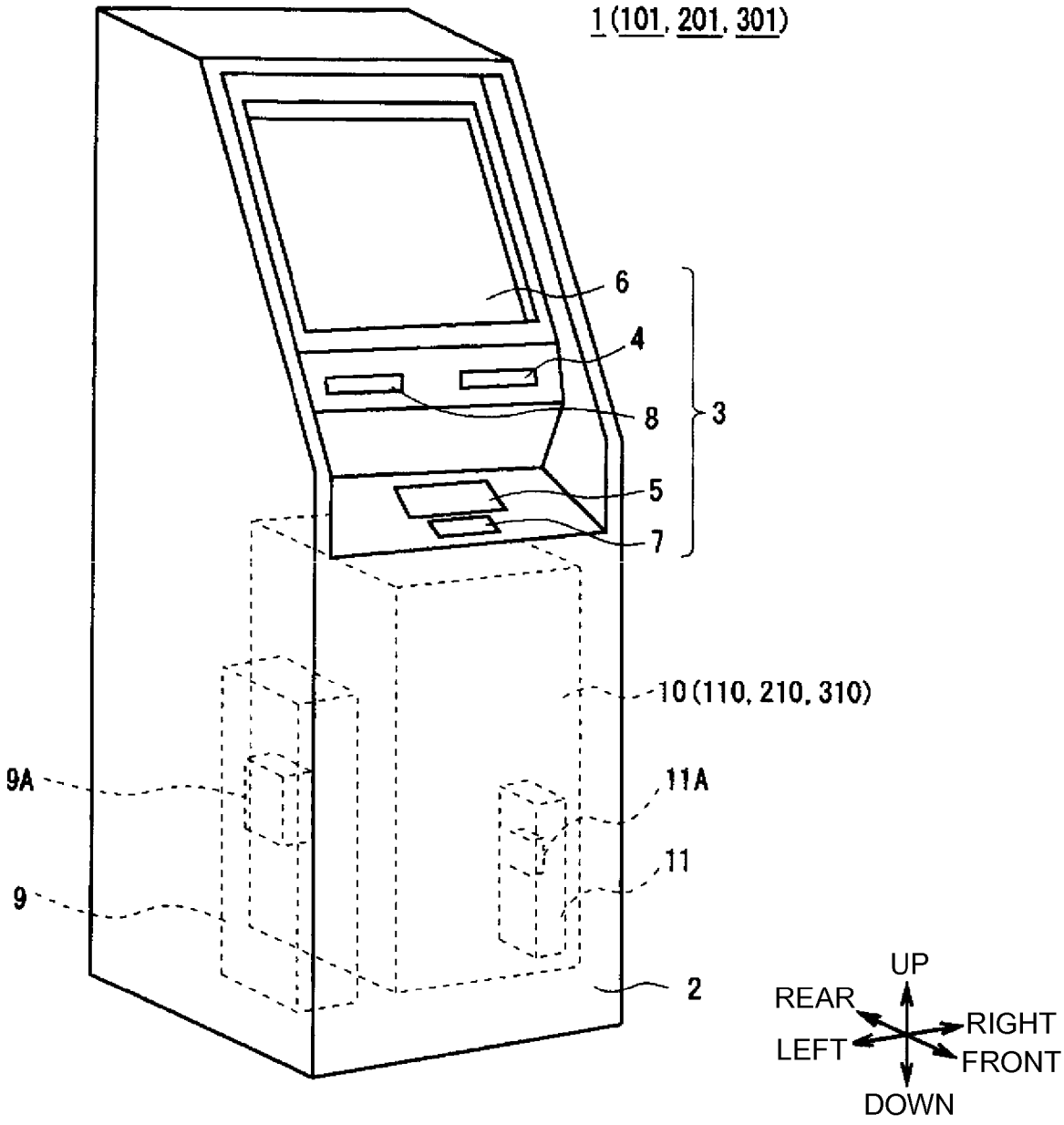
FIG. 1 is a perspective view showing a front surface, a left side surface, and an upper surface in a configuration of an automatic teller machine.

An automatic teller machine 1, the outward appearance of which is shown in FIG. 1, is configured around a box-like housing 2, is installed in a financial institution or the like, for example, and performs cash-related transactions, such as deposit transactions and withdrawal transactions, with customers.

The housing 2 has a shape where, in a state in which a customer is facing the front side of the housing 2, the place where it is easy for the customer to deposit banknotes and perform operations using a touch panel—that is, the part from the upper portion of the front surface to the upper surface—is diagonally cut away, and a customer service unit 3 is disposed in this part.

The customer service unit 3 is disposed with a card insertion and ejection opening 4, a deposit and withdrawal opening 5, an operation and display unit 6, a numerical keypad 7, and a receipt issuance opening 8, and the customer service unit 3 directly exchanges cash and passbooks with customers, notifies customers of information relating to transactions, and receives operation instructions.

The card insertion and ejection opening 4 is a part into which various types of cards such as cash cards are inserted and from which those cards are ejected. A card processing unit (not illustrated) that reads account numbers magnetically recorded on the various types of cards is disposed on the housing inner side of the card insertion and ejection opening 4.

The deposit and withdrawal opening 5 is a part into which banknotes to be deposited are deposited by customers and from which banknotes to be withdrawn are dispensed to customers. Further, the deposit and withdrawal opening 5 is opened or closed as a result of a shutter being driven.

The operation and display unit 6 includes the integration of an LCD (Liquid Crystal Display), which displays operation screens when transactions are performed, and a touch panel, with which transaction type selections, PIN numbers, and transaction amounts are input.

The numerical keypad 7 includes physical keys that receive the input of the numbers "0" to "9" and so forth and is used when a customer operates the numerical keypad 7 to input PIN numbers and transaction amounts.

The receipt issuance opening 8 is a part that issues receipts having printed thereon transaction details and so forth when transaction processing ends. A receipt processing unit (not illustrated) that prints the transaction details and so forth on the receipts is disposed on the housing inner side of the receipt issuance opening 8.

Below, the automatic teller machine 1 will be described with the side of the automatic teller machine 1 that the customer faces being defined as the front side, the opposite side of the front side being defined as the rear side, the right and left sides as seen from the standpoint of the customer facing the front side being defined as the right side and the left side, respectively, and the upper and lower sides as seen from the same standpoint being defined as the upper side and the lower side, respectively.

A main control unit 9, which centrally controls the entire automatic teller machine 1, and a banknote deposit and withdrawal machine 10, which performs various types of banknote-related processing, are disposed in the housing 2.

The main control unit 9 is configured around an unillustrated CPU (Central Processing Unit) and performs various types of processing of deposit transactions and withdrawal transactions by reading out and executing predetermined programs from an unillustrated ROM (Read Only Memory) or flash memory.

Further, the main control unit 9 has therein a storage unit 9A including a RAM (Random Access Memory), hard disk drive, or flash memory and stores various types of information in this storage unit 9A.

Some of the side surfaces of the housing 2, such as the front surface side and the rear surface side, are configured by doors that can open and close. That is, during transaction operations when the automatic teller machine 1 performs cash-related transactions with customers, the doors of the housing 2 are closed, whereby the banknotes stored in the banknote deposit and withdrawal machine 10 are protected. During maintenance work when a maintenance worker, for example, performs maintenance work, the doors of the housing 2 are opened as needed to allow the maintenance worker to easily perform work with respect to the parts inside the housing 2.

[1-2. Configuration of Banknote Deposit and Withdrawal Machine]

Figure 2:
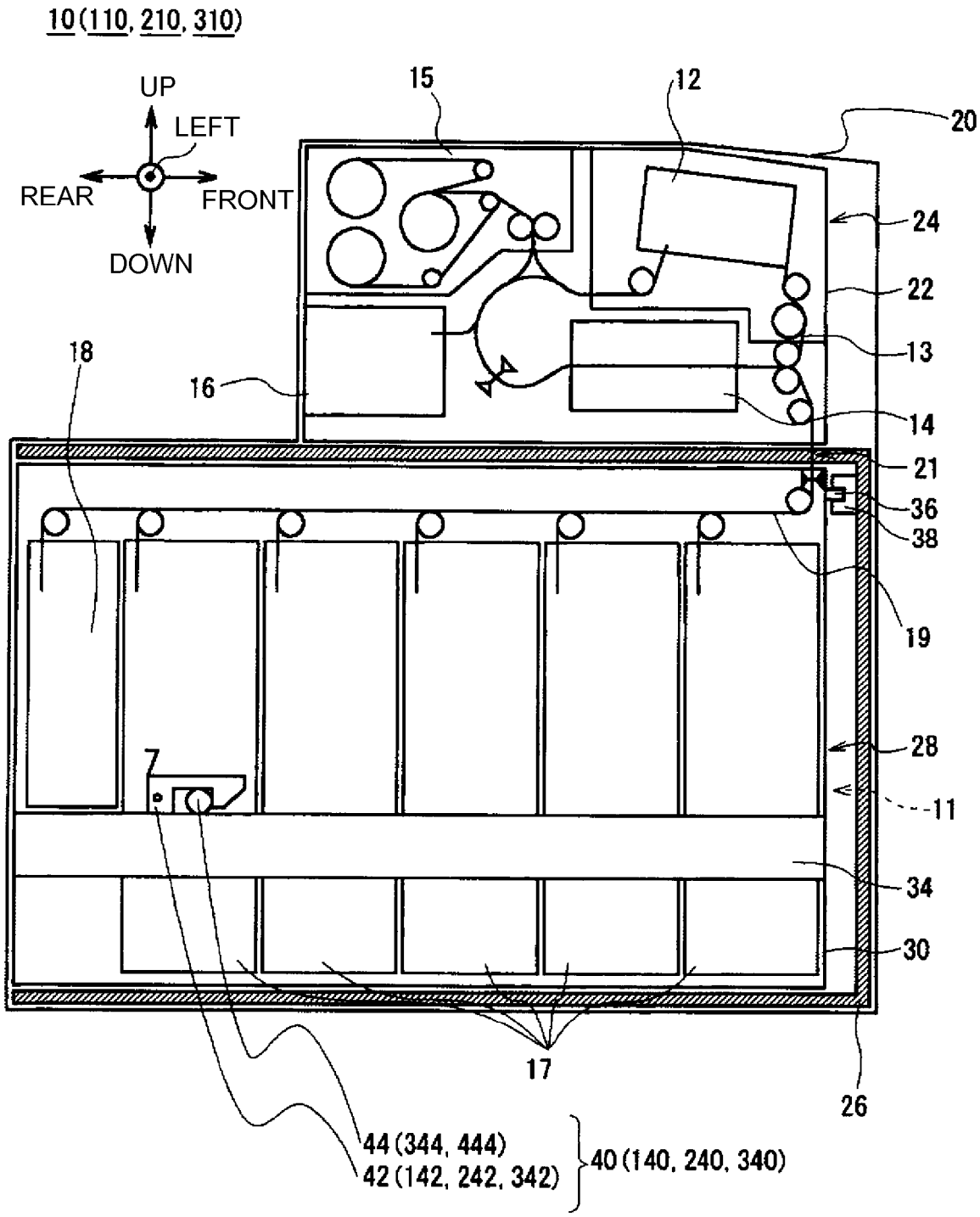
FIG. 2 is a left side surface view showing a configuration of a banknote deposit and withdrawal machine.

As shown in FIG. 2, which is a schematic side surface view of the banknote deposit and withdrawal machine 10, the banknote deposit and withdrawal machine 10 has a banknote deposit and withdrawal machine housing 20 inside of which are disposed various mechanisms relating to banknote deposit processing and withdrawal processing. Each part of the banknote deposit and withdrawal machine 10 is controlled by a banknote control unit 11.

An upper unit 24 enclosed by an upper frame 22 is disposed on the upper side of the banknote deposit and withdrawal machine 10, and a lower unit 28 enclosed by a robust safe housing 26 is disposed on the lower side of the banknote deposit and withdrawal machine 10.

A deposit and withdrawal unit 12, an upper conveyance path 13, an identification unit 14, a temporary holding unit 15, and a reject box 16 are incorporated into the upper unit 24. The upper unit 24 is locked by a predetermined lock portion (not illustrated) to the banknote deposit and withdrawal machine housing 20, whereby the upper unit 24 is positioned with high precision with respect to the banknote deposit and withdrawal machine housing 20.

Plural banknote cassettes 17 stored in a cassette frame 30, a lower conveyance path 19, and a recovery box 18 are incorporated into the lower unit 28.

The lower unit 28 is locked by a lock portion 40 including a lock mechanism 42 and a support portion 44 to the safe housing 26, which is fixed to the banknote deposit and withdrawal machine housing 20, whereby the lower unit 28 is positioned with high precision with respect to the safe housing 26.

In this way, the upper unit 24 and the lower unit 28 are mutually positioned with high precision, whereby the banknote deposit and withdrawal machine 10 can transfer banknotes between the upper conveyance path 13 and the lower conveyance path 19 in a transfer unit 21 while preventing banknote jams and so forth.

Error of about 3 mm is allowed for positional misalignment between the upper conveyance path 13 and the lower conveyance path 19 in the transfer unit 21.

Like the main control unit 9, the banknote control unit 11 is configured around an unillustrated CPU and performs various types of processing, such as processing for deciding the conveyance destinations of the banknotes, by reading out and executing predetermined programs from an unillustrated ROM or flash memory.

Further, the banknote control unit 11 has therein a storage unit 11A (FIG. 1) including a RAM and flash memory and stores various types of information in this storage unit 11A.

As for the banknote control unit 11, in the case of performing a deposit transaction in which the customer deposits banknotes, for example, predetermined operation inputs are received via the operation and display unit 6, and thereafter the shutter of the deposit and withdrawal opening 5 opens to allow the customer to deposit the banknotes into the deposit and withdrawal unit 12 disposed in the upper unit 24.

When the banknotes are deposited into the deposit and withdrawal unit 12, the shutter of the deposit and withdrawal opening 5 closes, and thereafter the deposit and withdrawal unit 12 pays out the banknotes one at a time and transfers the banknotes to the upper conveyance path 13. The upper conveyance path 13 moves, along the short edge direction, the banknotes configured in rectangular leaf-like form and conveys the banknotes to the identification unit 14.

The identification unit 14 conveys the banknotes therein and uses an optical element or a magnetic detection element to identify the denomination and authenticity of the banknotes as well as the extent of damage to the banknotes. Then, the identification unit 14 notifies the banknote control unit 11 of the banknote identification results. In accordance therewith, the banknote control unit 11 decides the conveyance destinations of the banknotes on the basis of the banknote identification results acquired from the identification unit 14.

At this time, the upper conveyance path 13 causes banknotes identified as normal banknotes in the identification unit 14 to be temporarily held in the temporary holding unit 15 by conveying those banknotes to the temporary holding unit 15. At the same time, the upper conveyance path 13 conveys to the deposit and withdrawal unit 12, and returns to the customer, reject banknotes identified as banknotes that should not be transacted.

Thereafter, the banknote control unit 11 has the customer finalize the amount of deposit via the operation and display unit 6, has the upper conveyance path 13 convey the banknotes held in the temporary holding unit 15 to the identification unit 14, has the identification unit 14 identify the denominations of the banknotes and the extent of damage to the banknotes, and acquires the identification results.

Then, if the extent of damage to the banknotes is large, the banknote control unit 11 determines that the banknotes should not be reutilized and has the upper conveyance path 13 convey and store the banknotes in the reject box 16. Further, if the extent of damage to the banknotes is small, the banknote control unit 11 determines that the banknotes should be reutilized, has the upper conveyance path 13 convey the banknotes to the identification unit 14, and has the identification unit 14 identify the banknotes again.

The upper conveyance path 13 transfers banknotes identified as normal banknotes in the identification unit 14 to the lower conveyance path 19 of the lower unit 28 and stores the banknotes in the paper cassettes 17 corresponding to the denominations of the banknotes. At the same time, the upper conveyance path 13 conveys banknotes identified as banknotes that should not be transacted to the recovery box 18.

Figure 3A:
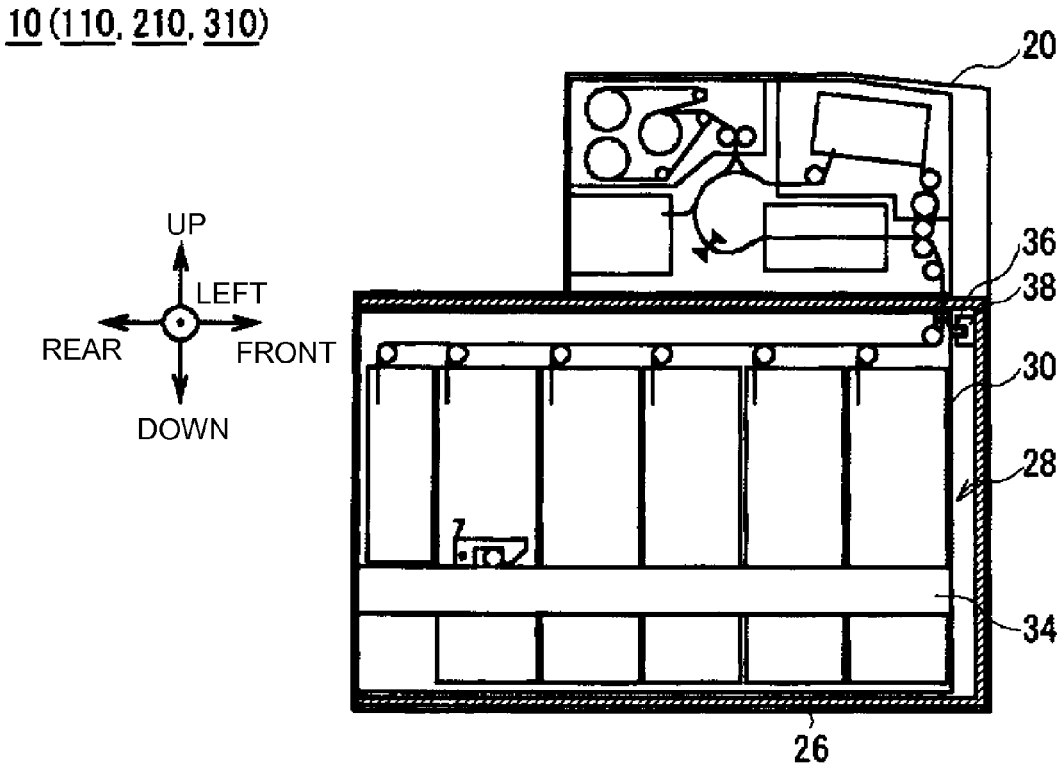
FIG. 3A is a left side surface view showing a stored state.
Figure 3B:
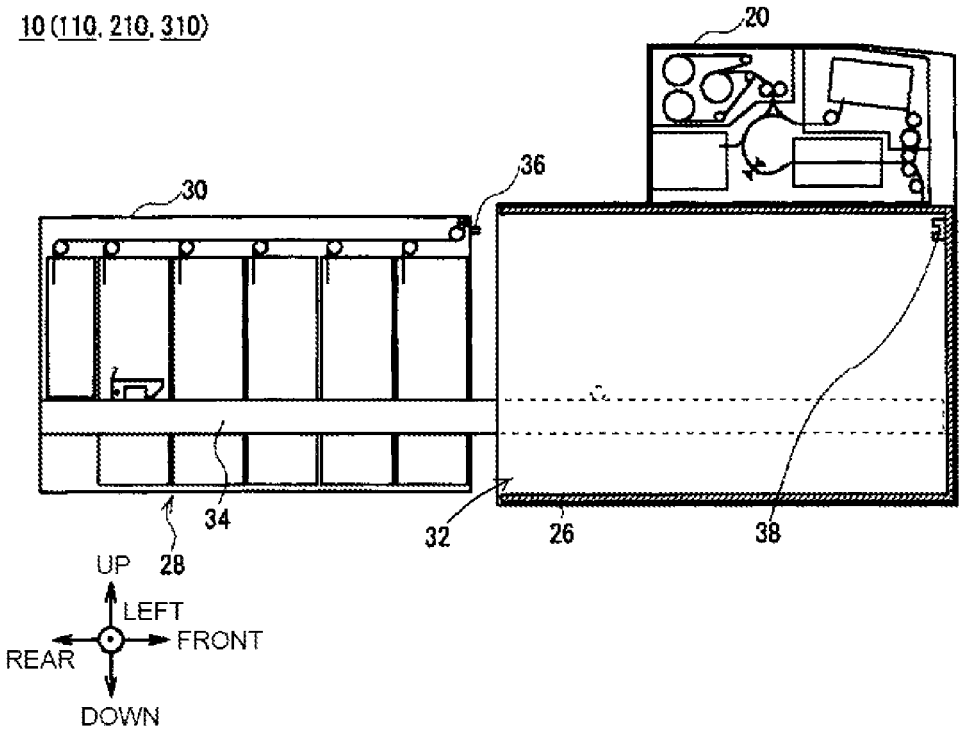
FIG. 3B is a left side surface view showing a pulled-out state.

As shown in FIG. 3B, a space is formed inside the safe housing 26, a communication hole 32 that allows that space to be communicated with the outside is formed in the rear side of the space, and the lower unit 28 is stored in the space. As shown in FIG. 3A and FIG. 3B, the cassette frame 30 of the lower unit 28 is attached to the safe housing 26 via slide rails 34.

The slide rails 34 are configured by a combination of rail-like parts extending in the front-and-rear direction and plural rollers (not illustrated), and the slide rails 34 allow the lower unit 28 to move linearly and smoothly in the front direction or the rear direction with respect to the safe housing 26.

Further, the slide rails 34 define the range of movement of the lower unit 28 with respect to the safe housing 26 and allow the lower unit 28 to move between the positions shown in FIG. 3A and FIG. 3B.

In the banknote deposit and withdrawal machine 10, in a case where transaction processing is performed with a customer or a case where maintenance work on the lower unit 28 is not performed, the lower unit 28 is stored inside the safe housing 26 as shown in FIG. 3A to thereby protect the parts and banknotes inside the lower unit 28. Hereinafter, this will be called a stored state of the lower unit 28.

In this stored state, the lower unit 28 is positioned in a predetermined storage position with respect to the safe housing 26.

In the banknote deposit and withdrawal machine 10, in a case where maintenance work on the lower unit 28 or work to fill the lower unit 28 with banknotes is performed by a maintenance worker or a clerk-in-charge in the financial institution, the lower unit 28 is moved in the rear direction as shown in FIG. 3B so that substantially the entire lower unit 28 is pulled out to the outside of the safe housing 26.

Hereinafter, the state in which the lower unit 28 has been pulled out to the rear side from the storage position will be called a pulled-out state, regardless of whether or not substantially the entire lower unit 28 is pulled out from the safe housing 26.

A projection 36 disposed projecting toward the inside surface of the safe housing 26 is formed on the front side surface of the cassette frame 30. Further, an interlock switch 38 that fits together with the projection 36 is disposed on the inside surface of the safe housing 26.

In the stored state of the lower unit 28, as shown in FIG. 3A, the projection 36 fits together with the interlock switch 38, whereby the interlock switch 38 transmits an "on" signal to the banknote control unit 11.

In the pulled-out state of the lower unit 28, as shown in FIG. 3B, the projection 36 separates from the interlock switch 38, whereby the interlock switch 38 transmits an "off" signal to the banknote control unit 11.

Because of this, when the banknote control unit 11 perceives that the lower unit 28 is in the pulled-out state, the banknote control unit 11 cuts off the supply of electrical power to the lower unit 28 to thereby stop the operation of the lower unit 28.

For this reason, when, for example, a maintenance worker puts a hand into the lower unit 28 to remove a banknote that has caused a conveyance failure, the banknote control unit 11 prevents the maintenance worker from sustaining an injury as a result of motors and rollers accidentally rotating. That is, in the present embodiment, the interlock switch 38 functions as a safety device.

Although the interlock switch 38 is switched on in the stored state, sometimes the interlock switch 38 remains on even in a state in which the lower unit 28 has been pulled out a little to the rear side from the stored state. For this reason, the banknote deposit and withdrawal machine 10 causes the lock portion 40 to lock to thereby reliably position the lower unit 28 in the storage position.

[1-3. Configuration of Lock Portion]

Figure 4:
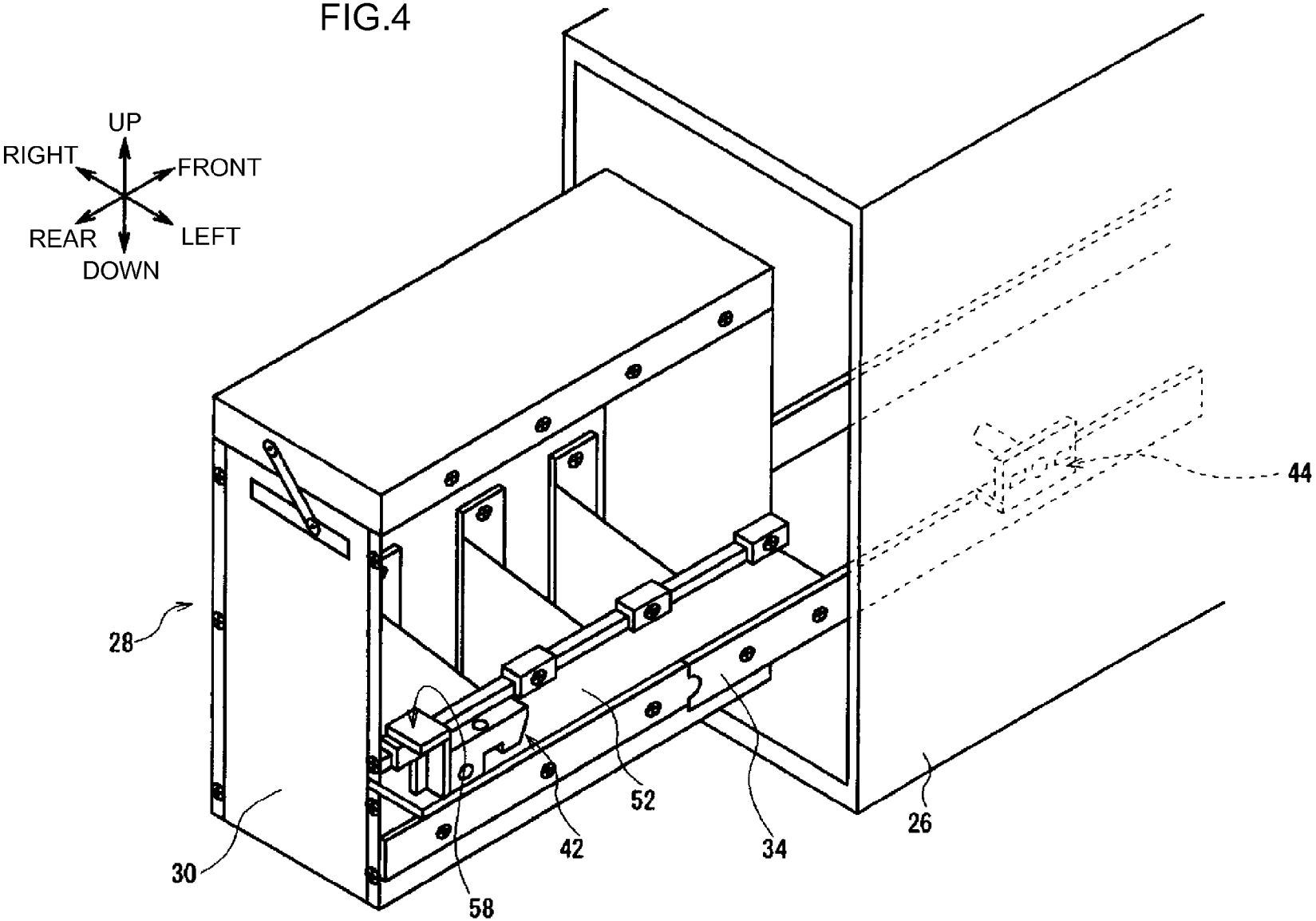
FIG. 4 is a perspective view showing a lower unit in the pulled-out state.

As shown in FIG. 4, the support portion 44 is attached to the inside surface of the left wall of the safe housing 26 in the neighborhood of the slide rail 34.

Further, the lock mechanism 42 is disposed on the left side surface of the lower unit 28 at substantially the same height as the support portion 44 in the neighborhood of the slide rail 34. Hereinafter, the lock mechanism 42 and the support portion 44 will also be grouped together and also called the lock portion 40.

When the lower unit 28 is pushed into the front of the inside of the safe housing 26 and the lock mechanism 42 hooks onto the support portion 44, the lower unit 28 becomes locked and positioned with respect to the safe housing 26.

When the lock mechanism 42 is unhooked from the support portion 44 so that the lock is released, the lower unit 28 can be pulled out rearward.

[1-3-1. Configuration of Support Portion]

Figure 5:
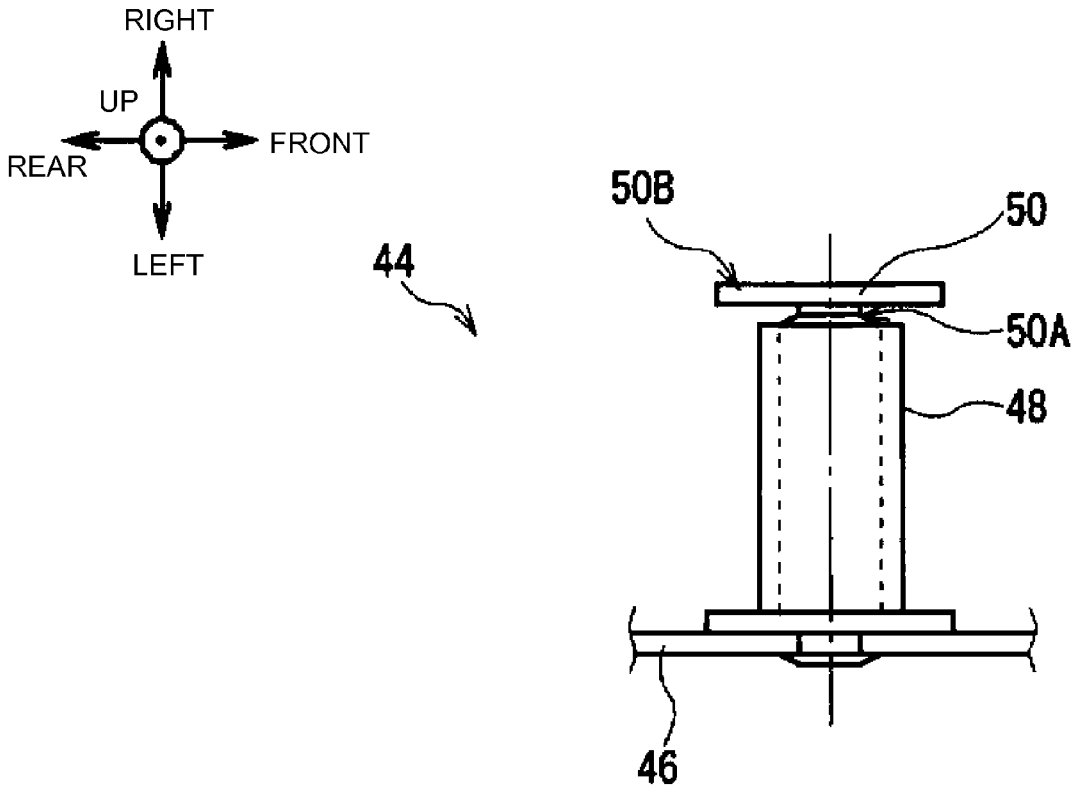
FIG. 5 is a plan view showing a configuration of a support portion.

As shown in FIG. 5, the support portion 44 is configured by a support base bracket 46, a lock pin 48, and a lock pin shaft 50.

The support base bracket 46 is made out of a metal plate and is fixed to the inside of the safe housing 26, and a hole portion (not illustrated) into which the lock pin 48 is inserted and fitted is formed in the support base bracket 46 in the right-and-left direction.

The lock pin shaft 50 has a shaft portion 50A, which is formed in a substantially cylindrical shape and whose left end part is fitted into and fixed in the hole portion of the support base bracket 46, and a shaft flange 50B, which has a larger outer diameter than the outer diameter of the shaft portion 50A and is formed on the right end of the shaft portion 50A.

The lock pin 48 has a cylindrical shape having the same outer diameter across the right-and-left direction, the inner diameter of the lock pin 48 is formed slightly larger than the outer diameter of the shaft portion 50A, and the lock pin 48 is loosely fitted onto the shaft portion 50A, whereby the lock pin 48 is disposed in such a way that it may freely rotate about the shaft portion 50A.

Further, the outer diameter of the shaft flange 50B of the lock pin shaft 50 is formed larger than the outer diameter of the lock pin 48. Because of this, even if the lock mechanism 42 (FIG. 4) were to become positionally misaligned in the rightward direction when it hooks onto the outer peripheral surface of the lock pin 48, the shaft flange 50B can prevent the lock mechanism 42 from coming off of the lock pin 48.

Moreover, because the lock pin 48 can freely rotate about the shaft portion 50A, the lock pin 48 rotates when the lock mechanism 42 engages with and disengages from the lock pint 48. Because of this, friction between the lock pin 48 and the lock mechanism 42 can be alleviated, the lock mechanism 42 can be prevented from engaging only with a specific part of the lock pin 48, and the physical load acting on the lock pin 48 can be alleviated.

[1-3-2. Configuration of Lock Mechanism]

As shown in FIG. 4, the lock mechanism 42 is part of the cassette frame 30 and is attached to an attachment plate 52 that extends planarly in the front-and-rear direction above the slide rail 34.

Figure 6A:
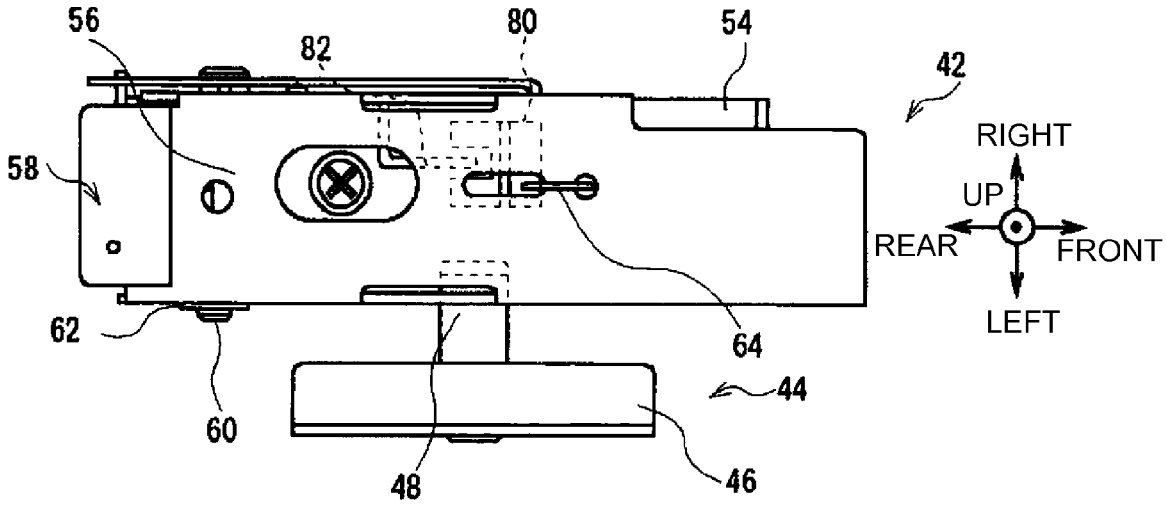
FIG. 6A shows a locked state according to a first embodiment and is a plan view.
Figure 6B:
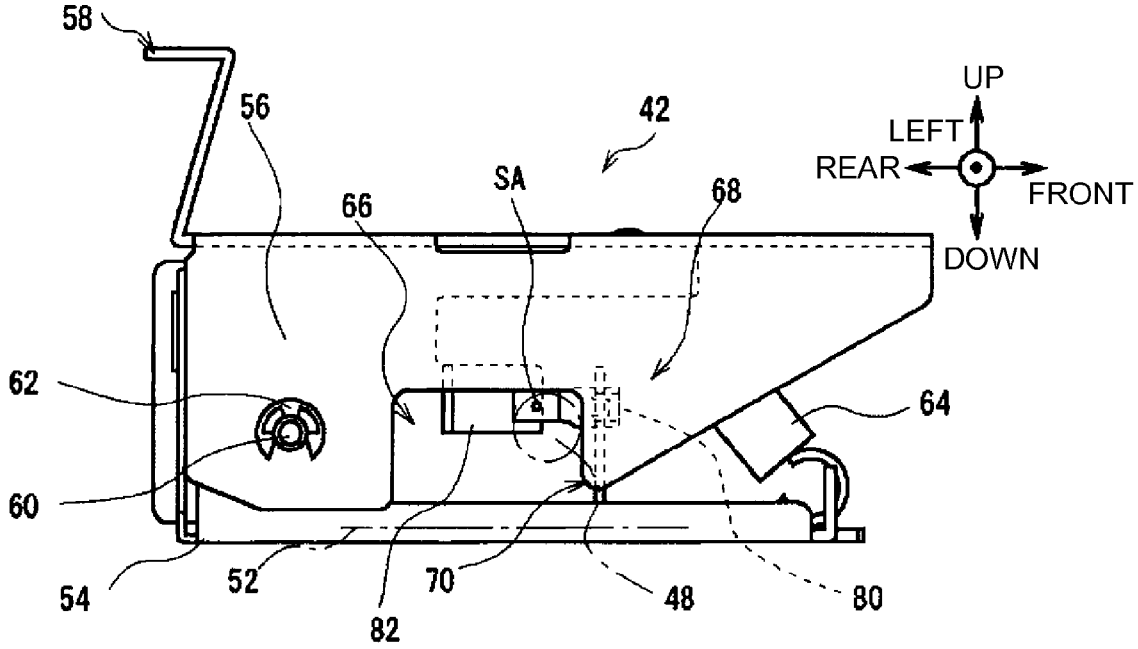
FIG. 6B shows the locked state according to the first embodiment and is a left side surface view.

As shown in FIG. 6B, the lock mechanism 42 is mainly configured by a lock base bracket 54, which is fixed to the attachment plate 52, and a lock bracket 56, which rotates using part of the lock base bracket 54 as a fulcrum.

The lock bracket 56 has a shape in which a metal plate having a predetermined thickness is bent in the shape of a square U whose underside is open as seen in a front view. A handle 58 that extends upward and is then bent rearward is disposed on the upper portion of the rear end of the lock bracket 56.

A lock shaft 60 is inserted in the right-and-left direction through the rear, somewhat lower side of the lock bracket 56 and the front lower side of the handle 58, and a lock shaft fixing member 62 is attached in the position of the lock shaft 60 on the left outside surface of the lock bracket 56. The lock shaft 60 is also inserted through the lock base bracket 54.

Because of this, the lock bracket 56 is configured in such a way that it can rotate in the clockwise direction and the counter-clockwise direction in FIG. 6B about the lock shaft 60.

Further, the upper end of a compression spring 64, whose lower end is attached to the lock base bracket 54, is attached to the upper portion of the lock bracket 56 in front of the lock shaft 60.

Because of this, a biasing force is applied to the lock bracket 56 in the clockwise direction in FIG. 6B about the lock shaft 60.

Further, when a maintenance worker applies a force to the handle 58 in the rear-side downward direction using a force larger than the biasing force of the compression spring 64, the lock bracket 56 rotates in the counter-clockwise direction in FIG. 6B with respect to the lock base bracket 54 using the lock shaft 60 as a fulcrum, and when that force is taken away, the lock bracket 56 rotates in the clockwise direction because of the biasing force of the compression spring 64.

A recessed portion 66, in which part of the lock bracket 56 has been cut out in the form of a square U from below to above, is disposed in the front-and-rear direction substantially central part of the lock bracket 56.

Further, a hook portion 68 having a substantially triangular shape as a result of its lower end being cut out upward heading frontward is formed in the range of the lock bracket 56 from the recessed portion 66 to the front end of the lock bracket 56. For this reason, a protruding portion 70 is formed on the rear-side lower end of the hook portion 68.

A blocking plate 82 that extends from the right side surface of the lock bracket 56 toward the left side, thereafter bends frontward, and extends planarly in the up-and-down and front-and-rear directions is formed on the lock bracket 56.

A lock sensor 80 including a photointerrupter fixed to the lock base bracket 54 is disposed on the front part of the recessed portion 66 in a position whose height is substantially the same as that of the lock shaft 60.

The lock sensor 80 has a light emitter and a light receiver disposed in opposition to one another in the right-and-left direction as indicated by the dashed lines in FIG. 6A, and the lock sensor 80 detects the presence of an object as a result of the light receiver detecting that an object has blocked the light from the light emitter.

In the lock sensor 80, cords (not illustrated) are connected from the light emitter and the light receiver to the banknote control unit 11 (FIG. 2). The banknote control unit 11 applies a predetermined voltage to the light emitter to cause the light emitter to emit light and detects the voltage of the light receiver, whereby the banknote control unit 11 determines a dark state, which is a state in which an object has been detected, and a light state, which is a state in which an object is not being detected.

Specifically, the lock sensor 80 takes as a sensing area SA the optical axis positioned in the circular mark part of the lock sensor 80 shown in FIG. 6B and detects whether or not an object is blocking the optical axis in the sensing area SA.

In the process of manufacturing the lower unit 28, for example, when assembling the lower unit 28, there are case where the cords of the lock sensor 80 become sandwiched in, for example, the cassette frame 30 (FIG. 4), which is made of metal.

In such times, there are cases where the cord extending from the light emitter of the lock sensor 80 and the cord extending from the light receiver short out.

In such cases, the banknote control unit 11 detects the light state because it detects, in the light receiver, the voltage applied to the light emitter.

There are cases where, due to age-related deterioration, for example, the cords of the lock sensor 80 become disconnected. In such cases, the banknote control unit 11 detects the dark state because it cannot apply the voltage to the light emitter or because it cannot detect the voltage of the light receiver.

[1-4. States of Lock Portion]

[1-4-1. Locked State]

In the locked state in which the lock mechanism 42 is locked to the support portion 44, the lock pin 48 is positioned in the corner of the front-side upper part of the recessed portion 66 as shown in FIG. 6B, in which the position of the lock pin 48 is indicated by a dashed line.

The lock sensor 80 is disposed on the front-side upper part of the recessed portion 66 and on the right side of the right end portion of the lock pin 48 in the locked state—that is, in the neighborhood of the position where the lock bracket 56 hooks onto the lock pin 48.

At this time, the lock bracket 56 is pushed in the downward direction against the lock pin 48 by the biasing force of the compression spring 64, and further movement of the lock bracket 56 in the downward direction is controlled.

Further, in this locked state, in a case where a force in the rear direction has been applied with respect to the lock bracket 56, the hook portion 68 comes into contact with the lock pin 48, whereby rearward movement of the lock bracket 56 is controlled.

The blocking plate 82 is, in the locked state, positioned in the sensing area SA of the lock sensor 80 and formed in such a way as to block the light from the light emitter to the light receiver. At this time, the banknote control unit 11 detects the dark state.

In this way, in the locked state, the hook portion 68 of the lock bracket 56 hooks onto the lock pin 48. Because of this, the lower unit 28 is positioned in the storage position with respect to the safe housing 26.

Further, in this locked state, the interlock switch 38 is switched on because the lower unit 28 is positioned in the storage position of the safe housing 26.

In this way, in the locked state, the banknote control unit 11 detects the "on" state of the interlock switch 38 and the dark state of the lock sensor 80.

[1-4-2. Pulled-out State]

As described above, when, in the locked state, a force is applied to the handle 58 in the rear-side downward direction using a force greater than the biasing force of the compression spring 64, the lock bracket 56 rotates in the counter-clockwise direction in FIG. 6B with respect to the lock base bracket 54 using the lock shaft 60 as a fulcrum.

Here, when pulling out the lower unit 28 from the safe housing 26, the lock bracket 56 is rotated until the lower end of the protruding portion 70 crosses over the upper end of the lock pin 48, and when the lower unit 28 is pulled in the rear direction, the hook portion 68 of the lock bracket 56 comes off of the lock pin 48.

Figure 7A:
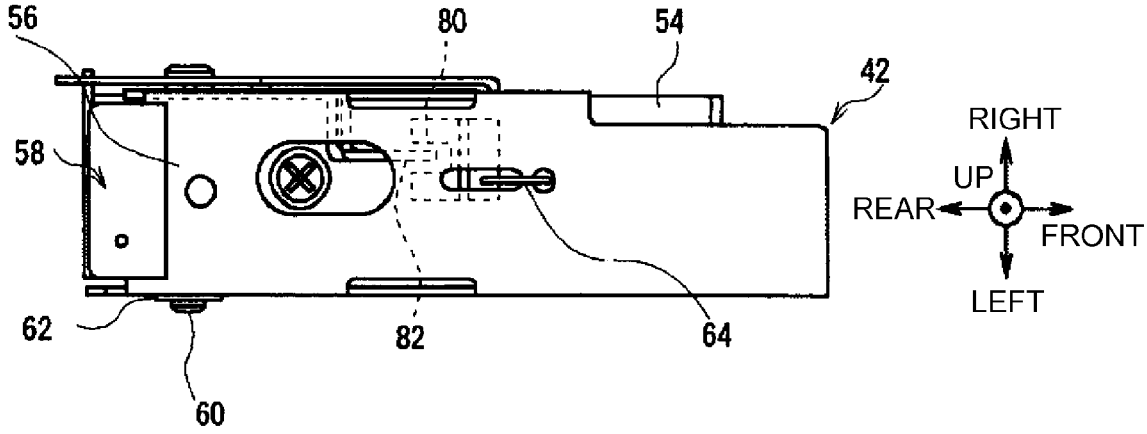
FIG. 7A shows the pulled-out state according to the first embodiment and is a plan view.
Figure 7B:
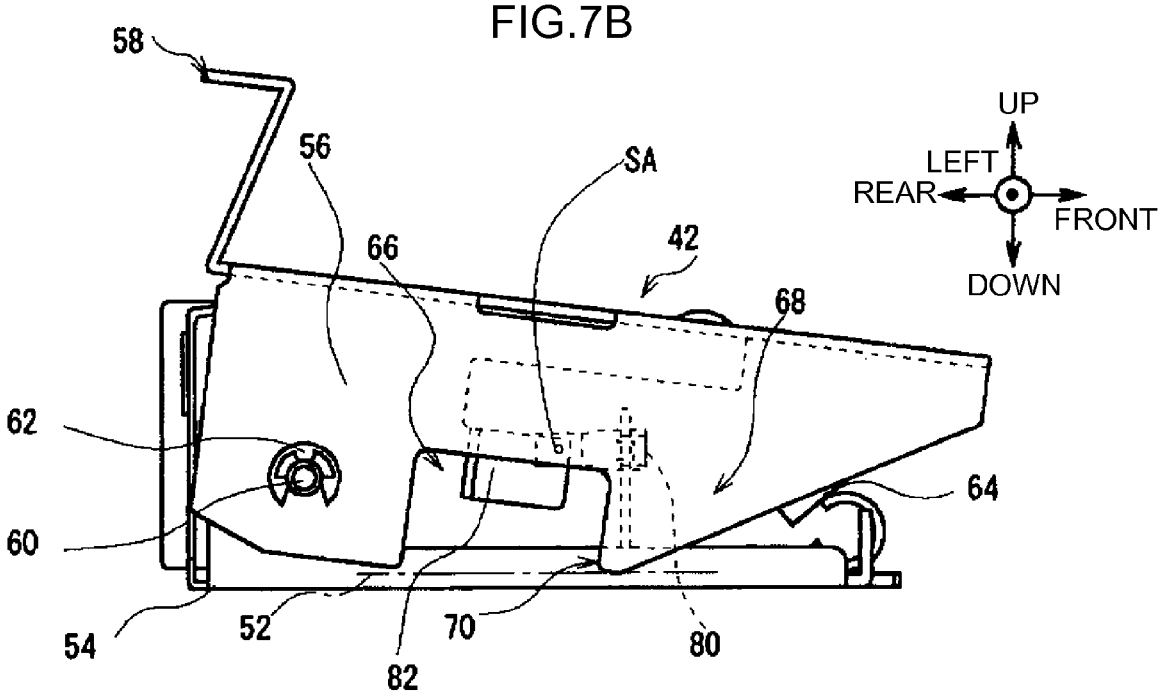
FIG. 7B shows the pulled-out state according to the first embodiment and is a left side surface view.
Figure 7C:
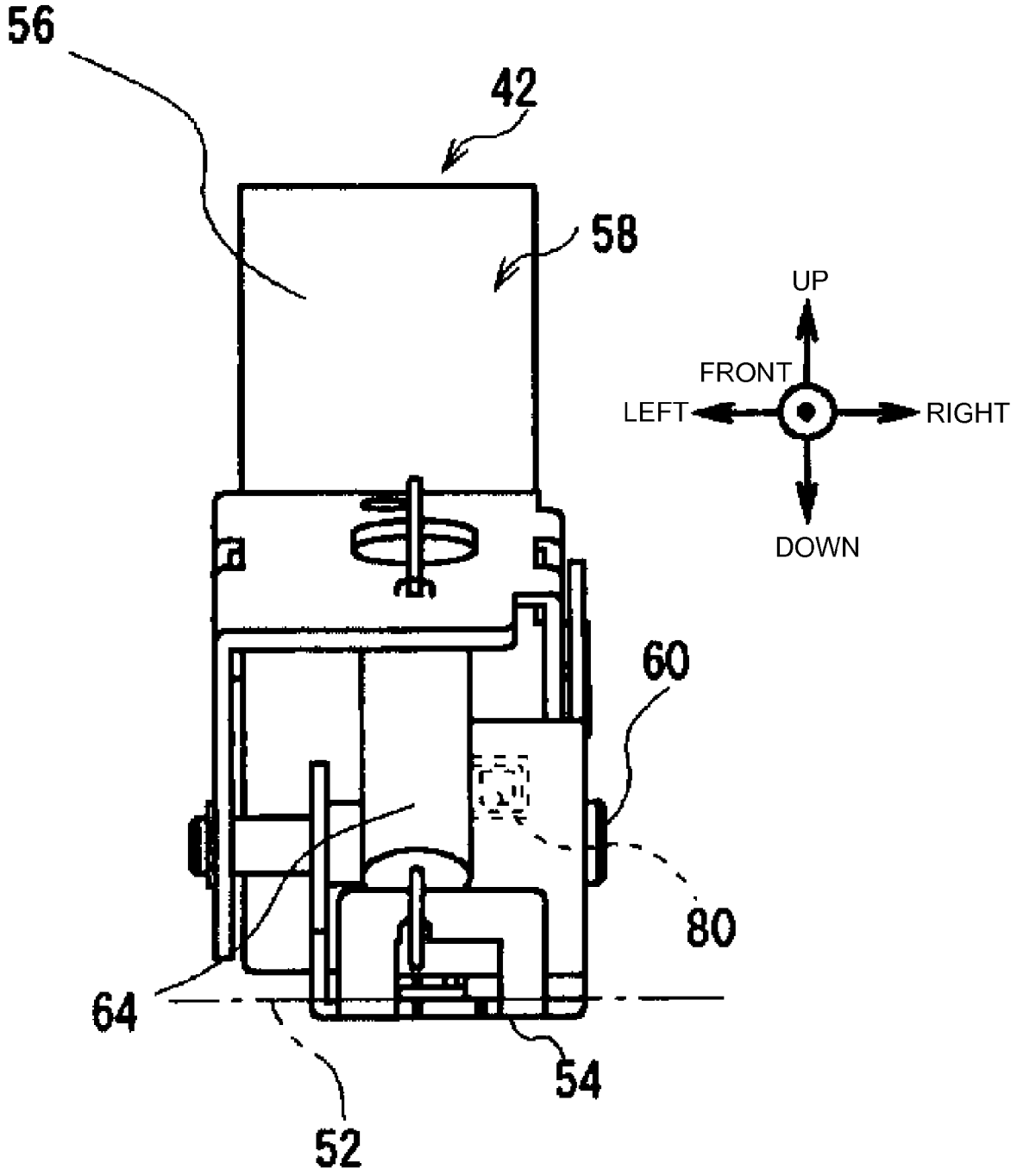
FIG. 7C shows the pulled-out state according to the first embodiment and is a front view.

In this pulled-out state, as shown in FIG. 7B, the lock bracket 56 rotates further in the clockwise direction than in the locked state because of the biasing force of the compression spring 64, but the rotation of the lock bracket 56 is controlled as a result of the protruding portion 70 coming into contact with the attachment plate 52.

In accompaniment with this, the blocking plate 82 also rotates further in the clockwise direction than in the locked state about the lock shaft 60 and moves in the downward direction with respect to the lock sensor 80, but the blocking plate 82 remains positioned in such a way as to block the sensing area SA of the lock sensor 80.

For this reason, in the pulled-out state also, the banknote control unit 11 detects the dark state like in the locked state.

Further, in this pulled-out state, the interlock switch 38 is switched off because the lower unit 28 is in the state in which it is pulled out from the safe housing 26.

When the lower unit 28 is pushed into the safe housing 26 from this pulled-out state, the lower end surface of the hook portion 68 of the lock bracket 56 slides on the lock pin 48, whereby the lock bracket 56 rotates in the counter-clockwise direction about the lock shaft 60, and when the protruding portion 70 crosses over the lock pin 48, the lock pin 48 enters the recessed portion 48 and the lock portion 40 enters the locked state.

In this way, in the pulled-out state, the banknote control unit 11 detects the "off" state of the interlock switch 38 and the dark state of the lock sensor 80 as shown in FIG. 9.

[1-4-3. Half-locked State]

Figure 8A:
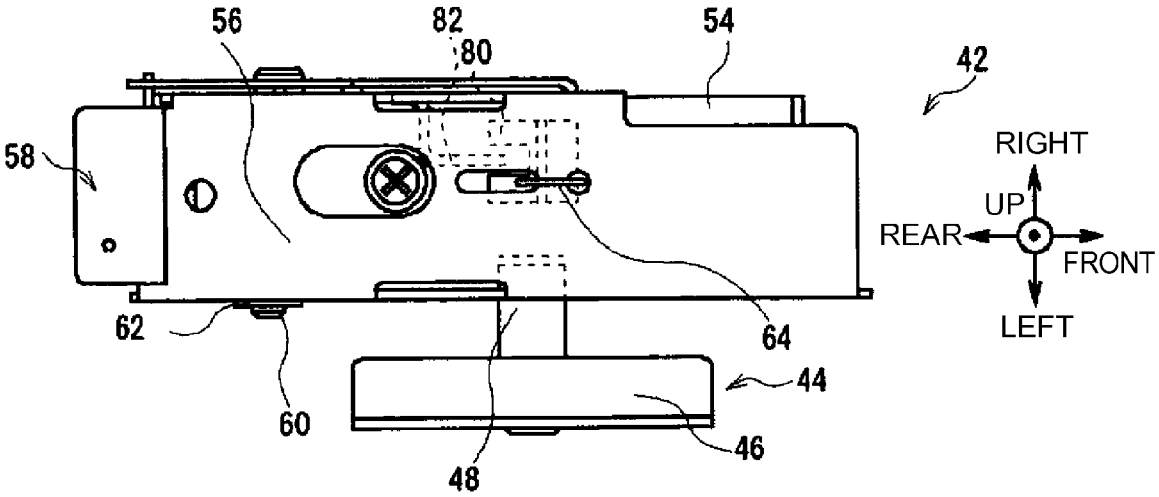
FIG. 8A shows a half-locked state according to the first embodiment and is a plan view.
Figure 8B:
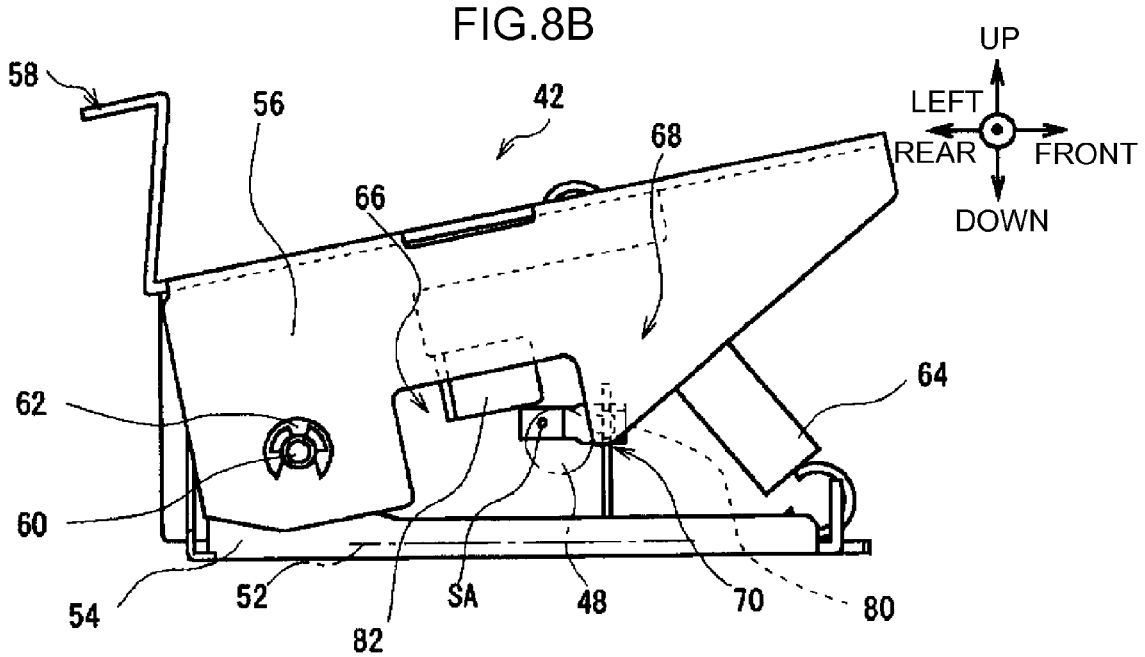
FIG. 8B shows the half-locked state according to the first embodiment and is a left side surface view.
Figure 8C:
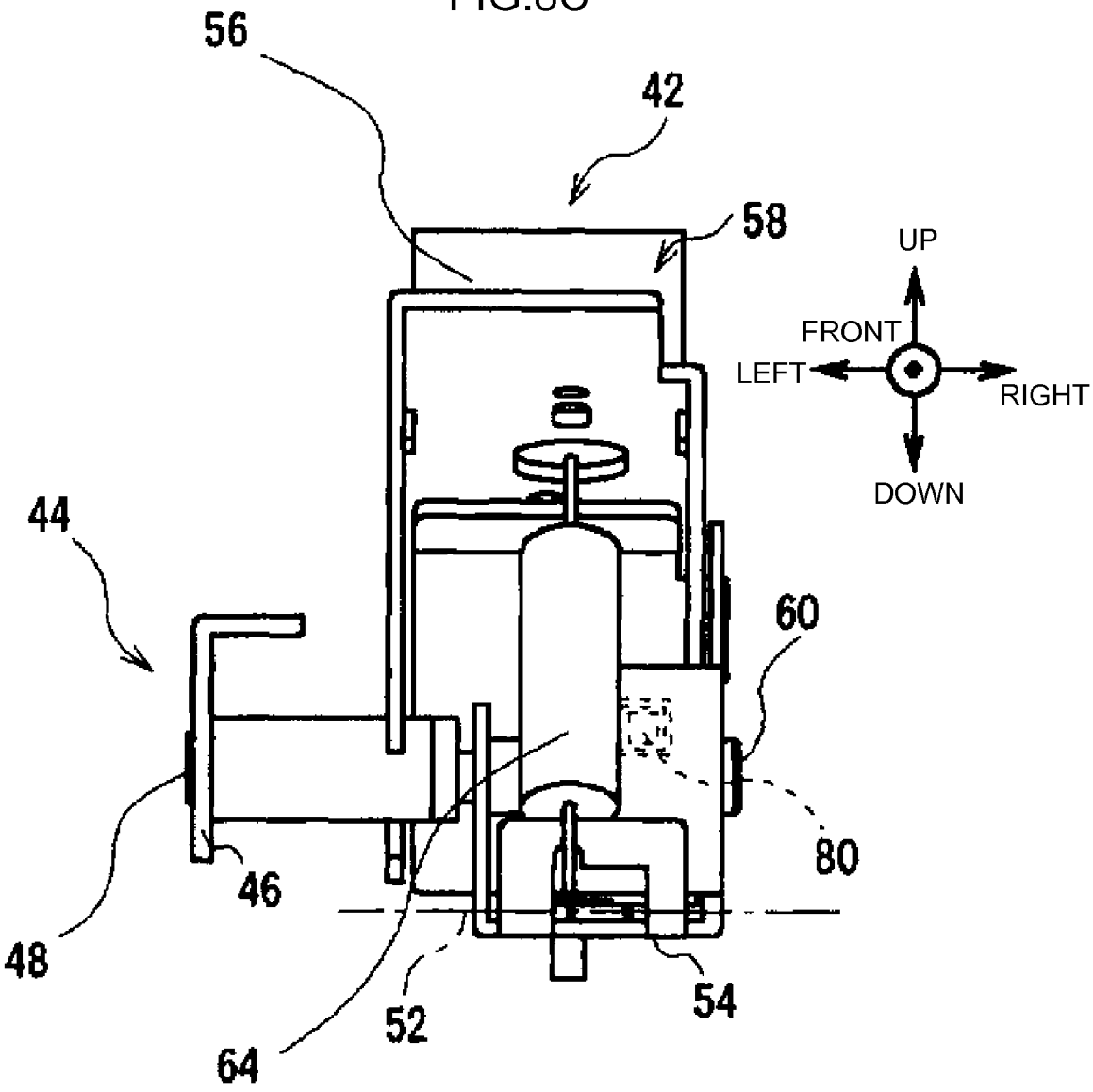
FIG. 8C shows the half-locked state according to the first embodiment and is a front view.

In a case where, for example, pushing has been insufficient when pushing the lower unit 28 into the safe housing 26 from the pulled-out state, there is the potential for the lock portion 40 to enter a half-locked state, which is a state in which the protruding portion 70 is caught on the lock pin 48 as shown in FIG. 8A, FIG. 8B, and FIG. 8C.

In this half-locked state, the lower unit 28 is not appropriately positioned with respect to the safe housing 26 like in the locked state but is in a state close to the locked state, so the interlock switch 38 is switched on.

In this half-locked state, as shown in FIG. 8B, the lock bracket 56 is biased in the clockwise direction by the biasing force of the compression spring 64, but the protruding portion 70 is caught on the lock pin 48.

For this reason, the lock bracket 56 is in a state in which it is rotated further in the counter-clockwise direction than in the locked state. In accompaniment with this, the blocking plate 82 is also in a position in which it is rotated further in the counter-clockwise direction than in the locked state about the lock shaft 60 and moves in the upward direction with respect to the lock sensor 80.

Because of this, the blocking plate 82 is positioned higher than the lock sensor 80 and moves to a position in which it does not block the sensing area SA of the lock sensor 80.

For this reason, in the half-locked state, in contrast to the locked state and the pulled-out state, the banknote control unit 11 detects the light state, which indicates that the light from the light emitter is not being blocked.

Because of this, in the half-locked state, the banknote control unit 11 detects the "on" state of the interlock switch 38 and the light state of the lock sensor 80 as shown in FIG. 9.

In this way, in the lock portion 40, the shape of the blocking plate 82 of the lock bracket 56 and the positional relationship between the lock sensor 80 and the various members are set in such a way that the dark state is obtained in the locked state and the pulled-out state, which are normal states, and the light state is obtained in the half-locked state, which is an abnormal state.

[1-5. Operation and Effects]

In the above configuration, in the banknote deposit and withdrawal machine 10, the lock sensor 80 is disposed in the neighborhood of the hook portion 68, and the blocking plate 82 formed integrally with the lock bracket 56 blocks or does not block the sensing area SA of the lock sensor 80.

For that reason, the banknote deposit and withdrawal machine 10 can determine that the lock portion 40 is in the half-locked state when the banknote deposit and withdrawal machine 10 detects the light state different from the dark state that is a normal state.

In this half-locked state, the lower unit 28 is not positioned in the storage position in which the lower unit 28 is appropriately stored with respect to the safe housing 26.

Conventionally, when the interlock switch 38 has been switched on, the lower unit 28 has been in the storage position or a state close to the storage position, so the banknote deposit and withdrawal machine 10 has regarded the lower unit 28 as being in the stored state rather than in a maintenance state and has supplied electrical power to the lower unit 28 to convey the banknotes.

However, simply detecting that the interlock switch 38 has been switched on does not necessarily mean that the lower unit 28 is positioned in the storage position with respect to the safe housing 26 and has been insufficient.

For this reason, the banknote deposit and withdrawal machine 10 has conveyed the banknotes even in the half-locked state, so when a vibration or the like is applied, there has been the potential for the lock mechanism 42 to come off of the support portion 44 so that the position of the lower unit 28 with respect to the safe housing 26 becomes misaligned and a banknote jam occurs.

In contrast, the banknote deposit and withdrawal machine 10 uses the lock sensor 80 different from the interlock switch 38 to sense the state of the lower unit 28, detects the half-locked state even if the interlock switch 38 is in an "on" state, and, in a case where the banknote deposit and withdrawal machine 10 has detected the half-locked state, does not transfer the banknotes between the upper unit and the lower unit 28.

Because of this, the banknote deposit and withdrawal machine 10 can raise the positional precision of the lower unit 28 and can prevent banknote jams.

In a case where the interlock switch 38 is on and the lock sensor 80 is in the dark state, the banknote deposit and withdrawal machine 10 determines that the lower unit 28 is in the stored state because the lock portion 40 is in the locked state. Additionally, by supplying electrical power to the lower unit 28, the banknote deposit and withdrawal machine 10 can move the various parts disposed in the lower unit 28.

Further, as shown in FIG. 9, in the locked state, the lock sensor 80 is in the dark state and the interlock switch 38 is on, while in the pulled-out state, the lock sensor 80 is in the dark state and the interlock switch 38 is off.

For this reason, the banknote deposit and withdrawal machine 10 can distinguish between the locked state and the pulled-out state by detecting whether the interlock switch 38 is on or off.

Further, in a case where a failure occurs as a result of the cords of the lock sensor 80 short-circuiting, the lock sensor 80 is in the light state like in the half-locked state.

Here, in a case where no failure occurs in the state in which the lower unit 28 has been pulled out from the safe housing 26, the lock sensor 80 is in the dark state.

In a case where, notwithstanding, the lock sensor 80 is in the light state, the banknote deposit and withdrawal machine 10 can distinguish that the lock sensor 80 is in a failed state caused by a short circuit.

Further, in a case where a failure occurs as a result of the cords of the lock sensor 80 becoming disconnected, the lock sensor 80 is in the dark state like in the locked state and the pulled-out state.

Here, when the lower unit 28 in the locked state is pulled out from the safe housing 26 in a case where the cords of the lock sensor 80 are not in a disconnected state, the lock sensor 80 sequentially changes from the dark state to the light state and back to the dark state in accompaniment with the lower unit 28 changing to the half-locked state and the pulled-out state. That is, when the lower unit 28 changes from the locked state to the pulled-out state, it does so by way of the half-locked state, so the banknote deposit and withdrawal machine 10 detects the light state at that time.

In a case where, that notwithstanding, the lock sensor 80 is always in a dark state, the banknote deposit and withdrawal machine 10 can distinguish that the lock sensor 80 is in a disconnected state.

In this way, the banknote deposit and withdrawal machine can distinguish whether the failure is due to a short-circuited state of the lock sensor 80 or is due to a disconnected state.

In this way, by combining the states of the lock sensor 80 and the states of the interlock switch 38, the banknote deposit and withdrawal machine 10 can distinguish between five states: the locked state, the half-locked state, the pulled-out state, a failure caused by a short circuit, and a failure caused by a disconnection.

Further, because the lock sensor 80 is disposed in the neighborhood of the hook portion 68, the banknote deposit and withdrawal machine 10 can detect the blocking plate 82 with high precision.

It is also possible to dispose the lock sensor 80 in the neighborhood of the protruding portion 70, without forming the blocking plate 82, and determine whether or not the protruding portion 70 is blocking the sensing area SA of the lock sensor 80.

However, in that case, in addition to the inherent function of the protruding portion 70, which is to cross over the lock pin 48 and lock when the lock bracket 56 moves in the front-and-rear direction, the function of blocking the lock sensor 80 is also given to the protruding portion 70, so the freedom of design becomes lower.

In contrast, in the lock mechanism 42, the blocking plate 82, rather than the protruding portion 70, is made to perform the function of blocking the lock sensor 80, so the freedom of design can be raised.

Further, the handle 58 of the lock bracket 56 is disposed in the neighborhood of the rear end of the lower unit 28. For this reason, with the banknote deposit and withdrawal machine 10, operability on the part of a maintenance worker when pulling out the lower unit 28 from the outside can be improved.

According to the above configuration, the banknote deposit and withdrawal machine 10 uses the interlock switch 38 to detect whether or not the lower unit 28, which executes predetermined processing when the lower unit 28 is stored in the predetermined storage position in the safe housing 26 and on which predetermined work is performed when the lower unit 28 is pulled out to the outside of the safe housing 26, has been pulled out from the safe housing 26; uses the lock portion 40 to lock the lower unit 28 in the storage position and release the lock to enable the lower unit 28 to be pulled out from the safe housing 26; uses the lock sensor 80 disposed in the neighborhood of the lock portion 40 to detect at least two states among the locked state in which the lock portion 40 is locking the lower unit 28, the half-locked state in which the lock portion 40 is incompletely locking the lower unit 28, and the pulled-out state in which the lock of the lock portion 40 has been released; and uses the banknote control unit 11 to distinguish between the three states of the locked state, the half-locked state, and the pulled-out state on the basis of the result of detection by the interlock switch 38 and the result of detection by the lock sensor 80.

Because of this, the banknote deposit and withdrawal machine 10 can detect the state of the lower unit 28 with respect to the safe housing 26 and raise the positional precision of the lower unit 28 with respect to the safe housing 26.

<2. Second Embodiment>

An automatic teller machine 101 according to a second embodiment shown in FIG. 1 is configured in the same way as the automatic teller machine 1 according to the first embodiment except that a lock portion 140 in a banknote deposit and withdrawal machine 110 shown in FIG. 2 is different from the lock portion 40 in the banknote deposit and withdrawal machine 10.

Figure 10A:
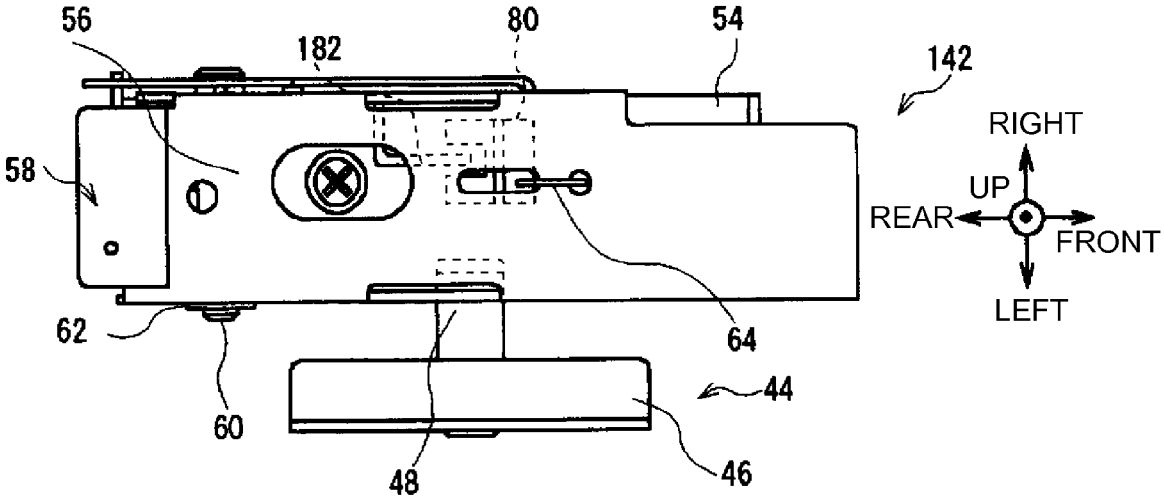
FIG. 10A shows the locked state according to a second embodiment and is a plan view.
Figure 10B:
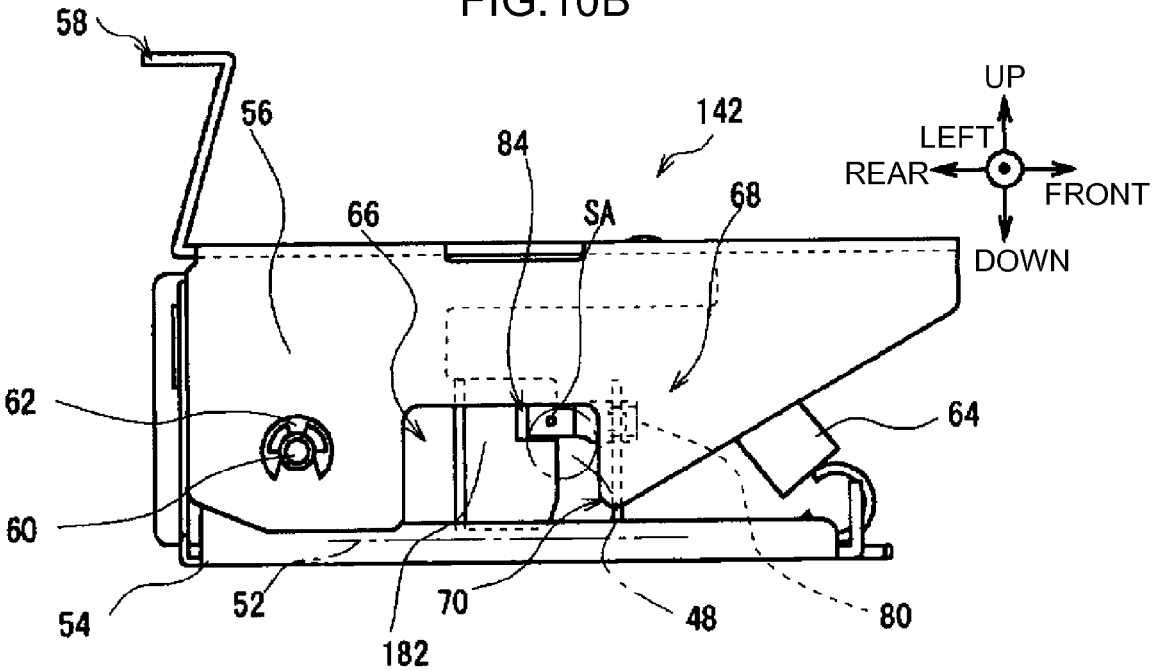
FIG. 10B shows the locked state according to the second embodiment and is a left side surface view.
Figure 10C:
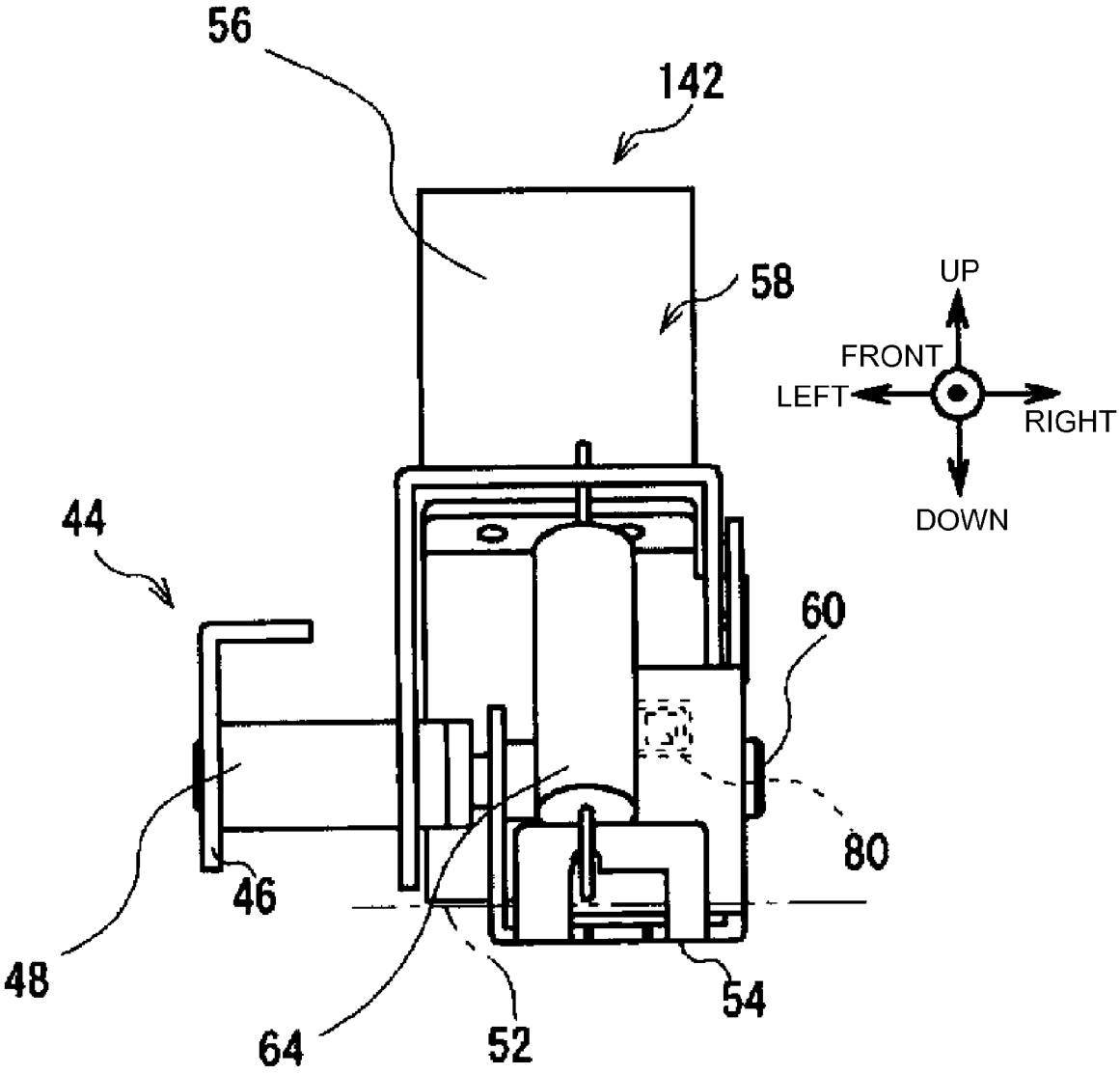
FIG. 10C shows the locked state according to the second embodiment and is a front view.

Further, the lock portion 140 according to the second embodiment is configured in the same way as the lock portion 40 according to the first embodiment except that the shape of a blocking plate 182 of a lock mechanism 142 shown in FIG. 10B is different from that of the blocking plate 82 (FIG. 6B) of the lock mechanism 42.

As shown in FIG. 10B, compared to the blocking plate 82, the lower end portion of the blocking plate 182 extends downward so that, overall, the blocking plate 182 is formed vertically longer than the blocking plate 82.

Further, a cutout portion 84, in which the part of the blocking plate 182 coinciding with the lock sensor 80 as seen in a side view in the locked state has been cut out in the shape of a square U, is formed in the blocking plate 182.

Figures 13, 14:
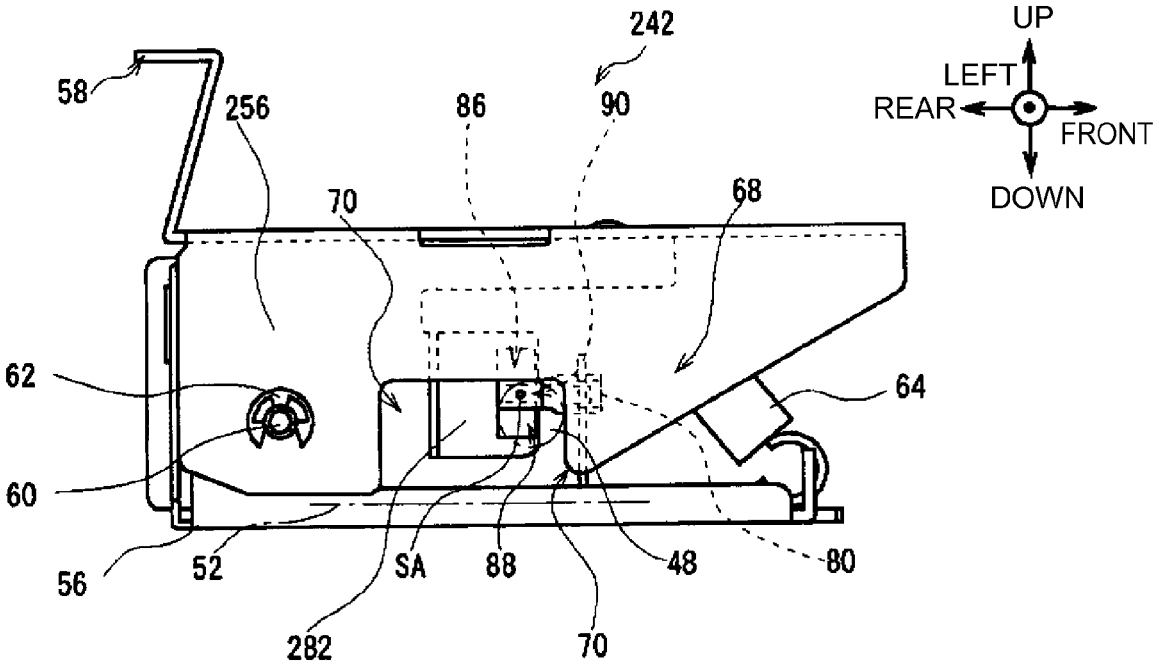
FIG. 13 is a schematic diagram showing states of the lock sensor and interlock switch according to the second embodiment.
FIG. 14 is a left side surface view showing the locked state according to a third embodiment.

For this reason, the blocking plate 182 is formed in such a way that, in the locked state, the cutout portion 84 is positioned in the sensing area SA of the lock sensor 80 and does not block the light from the emitter to the light receiver. At this time, the banknote control unit 11 detects the light state as shown in FIG. 13.

Figure 11A:
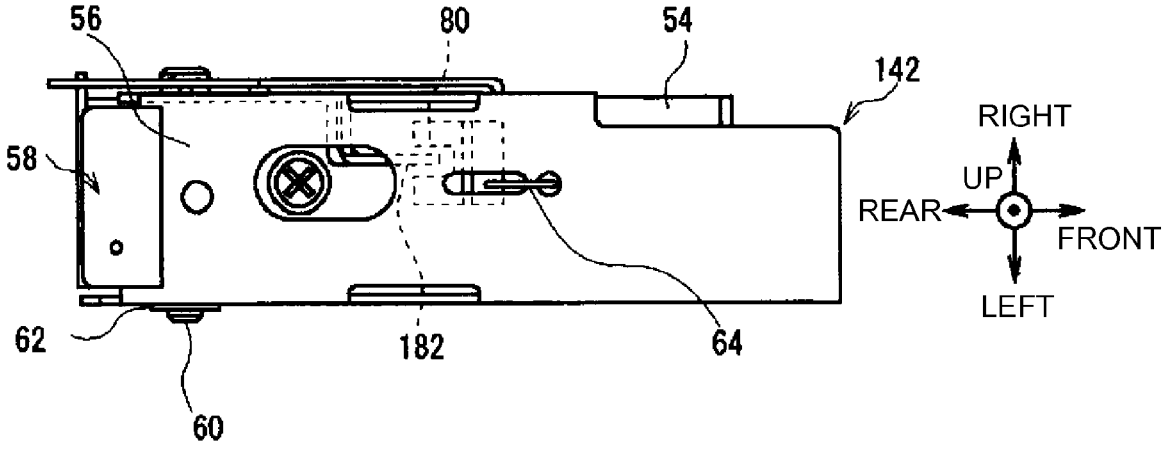
FIG. 11A shows the pulled-out state according to the second embodiment and is a plan view.
Figure 11B:
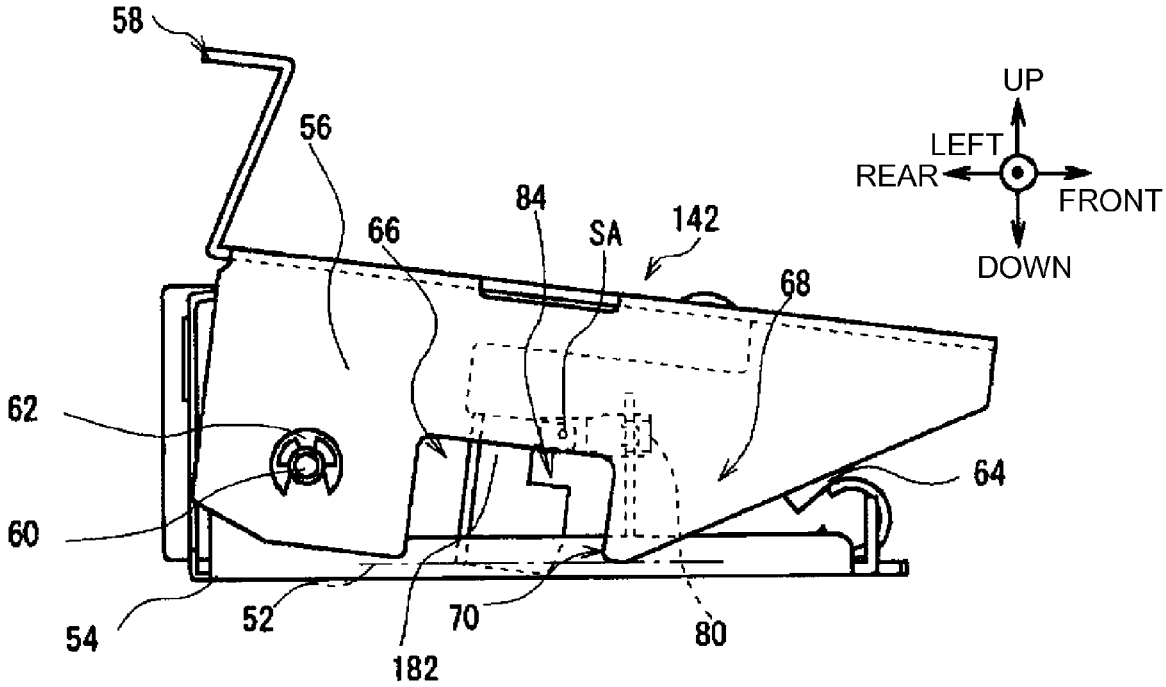
FIG. 11B shows the pulled-out state according to the second embodiment and is a left side surface view.
Figure 11C:
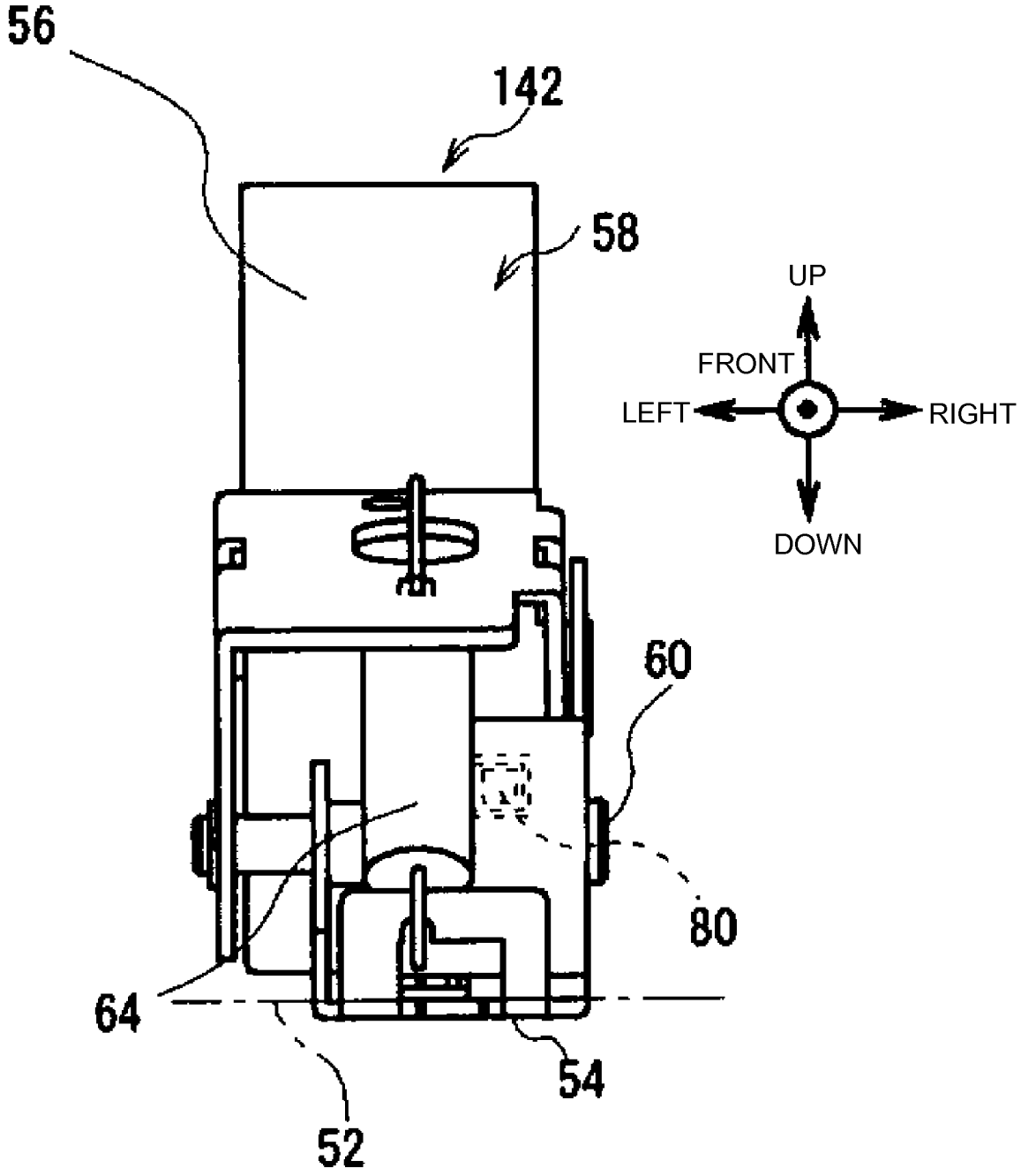
FIG. 11C shows the pulled-out state according to the second embodiment and is a front view.

In the pulled-out state, as shown in FIG. 11B, the blocking plate 182 is positioned so as to block the sensing area SA of the lock sensor 80. At this time, the banknote control unit 11 detects the dark state as shown in FIG. 13.

Figure 12A:
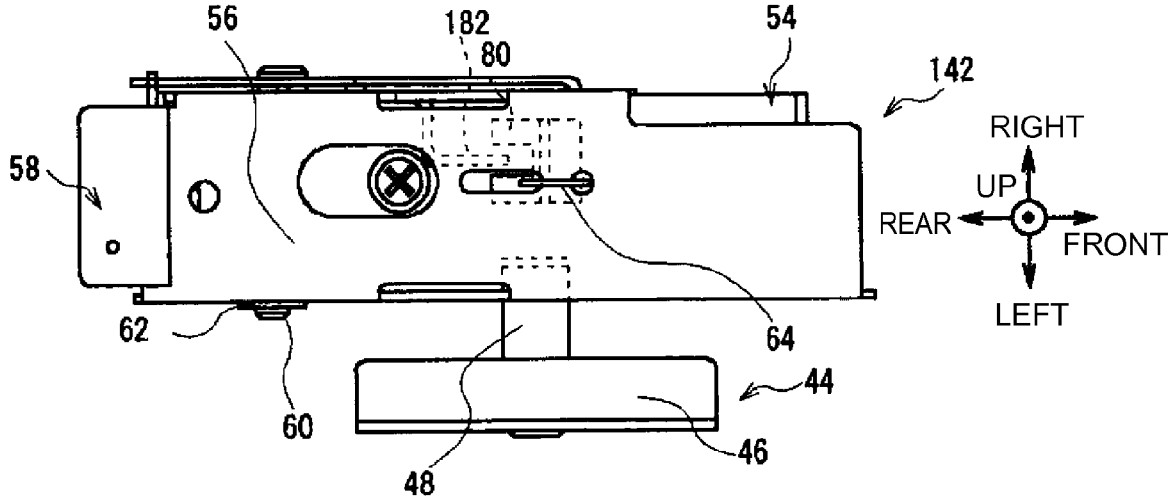
FIG. 12A shows the half-locked state according to the second embodiment and is a plan view.
Figure 12B:
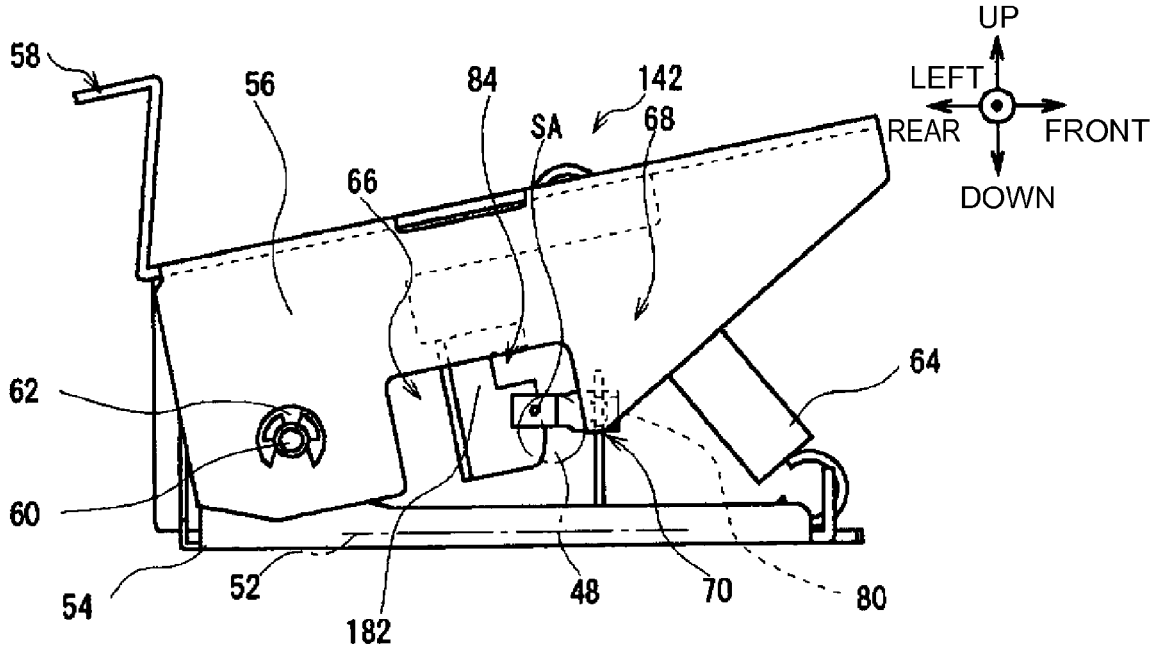
FIG. 12B shows the half-locked state according to the second embodiment and is a left side surface view.
Figure 12C:
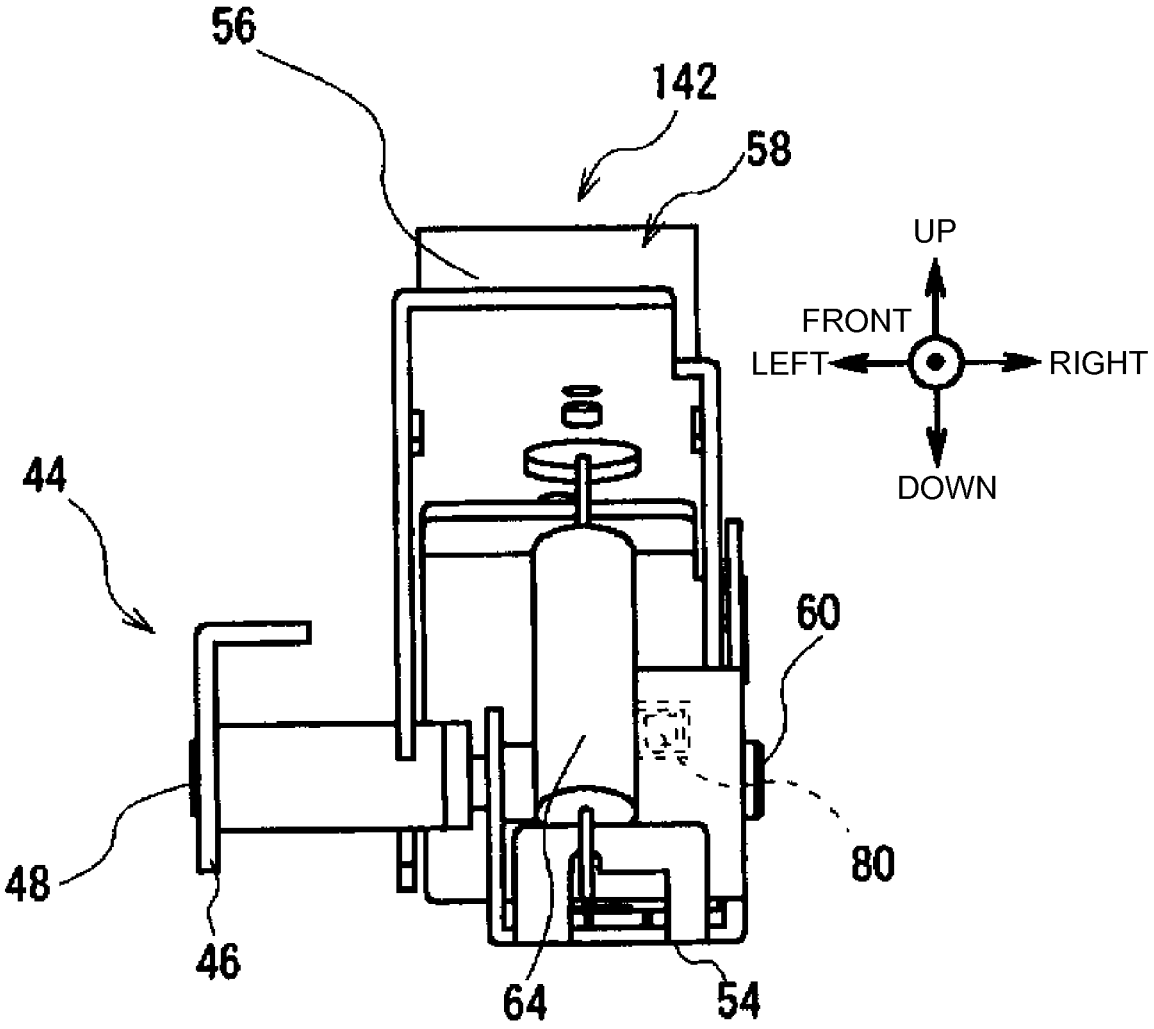
FIG. 12C shows the half-locked state according to the second embodiment and is a front view.

Further, in the half-locked state, as shown in FIG. 12B, the blocking plate 182 is positioned so as to block the sensing area SA of the lock sensor 80 like in the pulled-out state. At this time, the banknote control unit 11 detects the dark state as shown in FIG. 13.

In this way, in the lock portion 140, the shape of the blocking plate 182 of the lock bracket 156 and the positional relationship between the lock sensor 80 and the various members are set in such a way that the light state is obtained in the locked state and the dark state is obtained in the pulled-out state and the half-locked state.

Because of this, by combining the states of the lock sensor 80 and the states of the interlock switch 38, the banknote deposit and withdrawal machine 110 can detect five states: the locked state, the half-locked state, the pulled-out state, a failure caused by a short circuit, and a failure caused by a disconnection.

That is, the banknote deposit and withdrawal machine 110 can determine that the lower unit 28 is in the locked state in a case where the interlock switch 38 is on and the lock sensor 80 is in the light state, can determine that the lower unit 28 is in the half-locked state in a case where the interlock switch 38 is on and the lock sensor 80 is in the dark state, and can determine that the lower unit 28 is in the pulled-out state in a case where the interlock switch 38 is off and the lock sensor 80 is in the dark state.

Moreover, the banknote deposit and withdrawal machine 110 can determine that there is a failure caused by a short circuit in a case where the lock sensor 80 is always in the light state regardless of whether the interlock switch 38 is on or off and can determine that there is a failure caused by a disconnection in a case where the lock sensor 80 is always in the dark state regardless of whether the interlock switch 38 is on or off.

<3. Third Embodiment>

An automatic teller machine 201 according to a third embodiment shown in FIG. 1 is configured in the same way as the automatic teller machine 1 according to the first embodiment except that a lock portion 240 in a banknote deposit and withdrawal machine 210 shown in FIG. 2 is different from the lock portion 40 in the banknote deposit and withdrawal machine 10.

Further, the lock portion 240 according to the third embodiment is configured in the same way as the lock portion 40 according to the first embodiment except that the shape of a blocking plate 282 of a lock mechanism 242 shown in FIG. 14 is different from that of the blocking plate 82 (FIG. 6B) of the lock mechanism 42.

An upper-side hole portion 86 and a lower-side hole portion 88 that have rectangular shapes are formed in the blocking plate 282 on the upper side and the lower side of the part of the blocking plate 282 coinciding with the lock sensor 80 as seen in a side view in the locked state. Further, a central plate portion 90 is formed between the upper-side hole portion 86 and the lower-side hole portion 88.

For this reason, the blocking plate 282 is formed in such a way that, in the locked state, the central plate portion 90 is positioned in the sensing area SA of the lock sensor 80 and blocks the light from the light emitter to the light receiver as shown in FIG. 14. At this time, the banknote control unit 11 detects the dark state as shown in FIG. 17.

Figure 15:
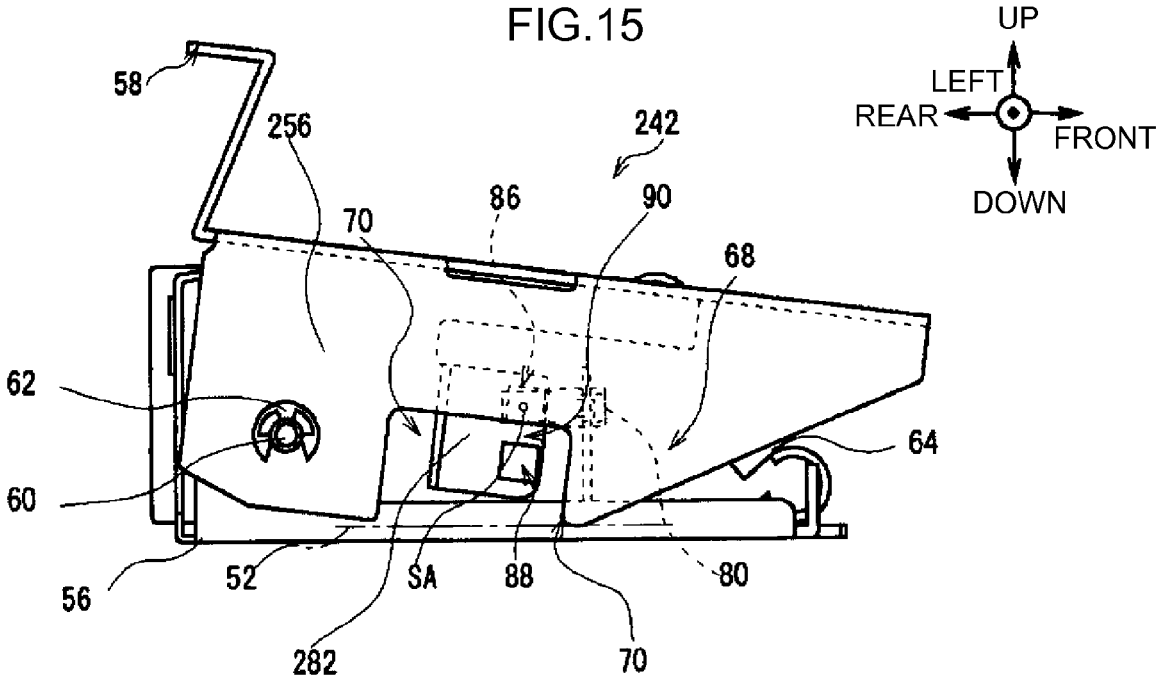
FIG. 15 is a left side surface view showing the pulled-out state according to the third embodiment.

In the pulled-out state, as shown in FIG. 15, the upper-side hole portion 86 of the blocking plate 282 is positioned in the sensing area SA of the lock sensor 80. At this time, the banknote control unit 11 detects the light state as shown in FIG. 17.

Figure 16:
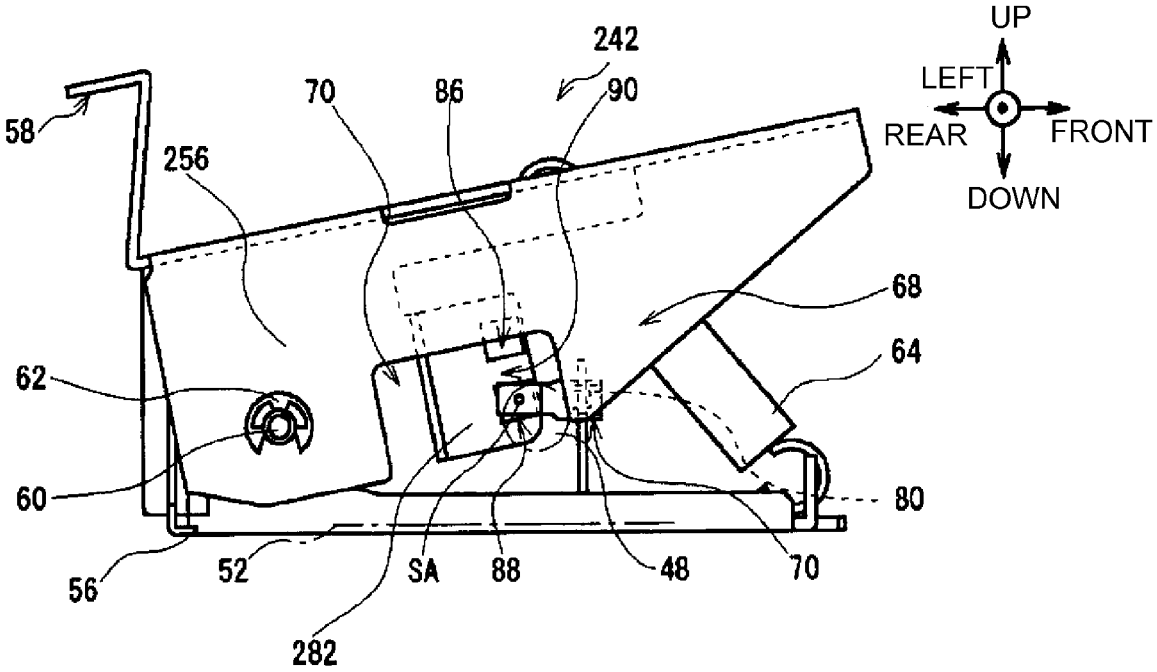
FIG. 16 is a left side surface view showing the half-locked state according to the third embodiment.

Further, in the half-locked state, as shown in FIG. 16, the lower-side hole portion 88 of the blocking plate 282 is positioned in the sensing area SA of the lock sensor 80. At this time, the banknote control unit 11 detects the light state as shown in FIG. 17.

In this way, in the lock portion 240, the shape of the blocking plate 282 of a lock bracket 256 and the positional relationship between the lock sensor 80 and the various members are set in such a way that the dark state is obtained in the locked state and the light state is obtained in the pulled-out state and the half-locked state.

In this way, by combining the states of the lock sensor 80 and the states of the interlock switch 38, the banknote deposit and withdrawal machine 210 can detect five states: the locked state, the half-locked state, the pulled-out state, a failure caused by a short circuit, and a failure caused by a disconnection.

<4. Fourth Embodiment>

An automatic teller machine 301 according to a fourth embodiment shown in FIG. 1 is configured in the same way as the automatic teller machine 1 according to the first embodiment except that a lock portion 340 in a banknote deposit and withdrawal machine 310 shown in FIG. 2 is different from the lock portion 40 in the banknote deposit and withdrawal machine 10.

Figure 18A:
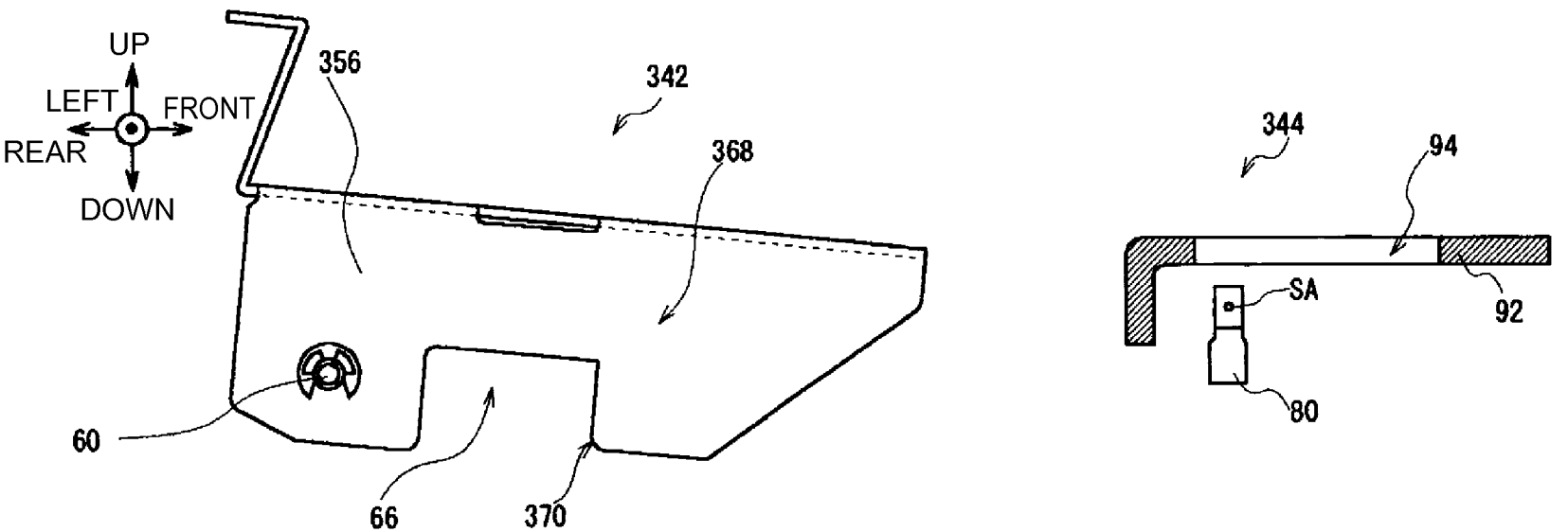
FIG. 18A shows the pulled-out state according to a fourth embodiment and is a left side surface view and a left sectional view.

As shown in FIG. 18A, a support portion 344 of the lock portion 340 is configured as a result of a lock receiving bracket 92, which has a shape in which a metal plate extending in the front-and-rear direction is bent in the downward direction at its rear end, is fixed to the inside of the safe housing (not illustrated).

Figure 18B:
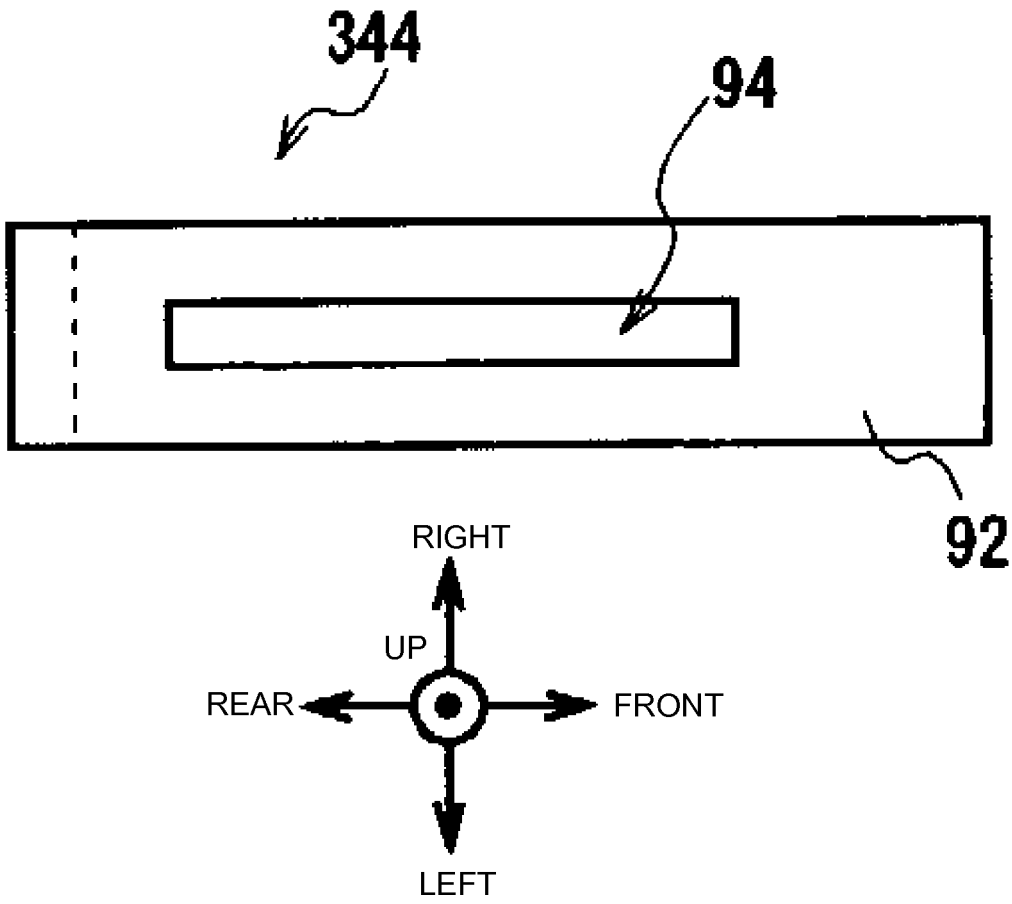
FIG. 18B shows the support portion according to the fourth embodiment and is a plan view.

Further, a receiving hole 94, which has a rectangular shape and extends in the front-and-rear direction as seen in a plan view (FIG. 18B), is formed in the lock receiving bracket 92 in such a way as to penetrate the lock receiving bracket 92 in the up-and-down direction.

The lock sensor 80, having the sensing area SA disposed in the upper portion thereof, is disposed below the rear end of the receiving hole 94 of the lock receiving bracket 92.

Figure 6C:
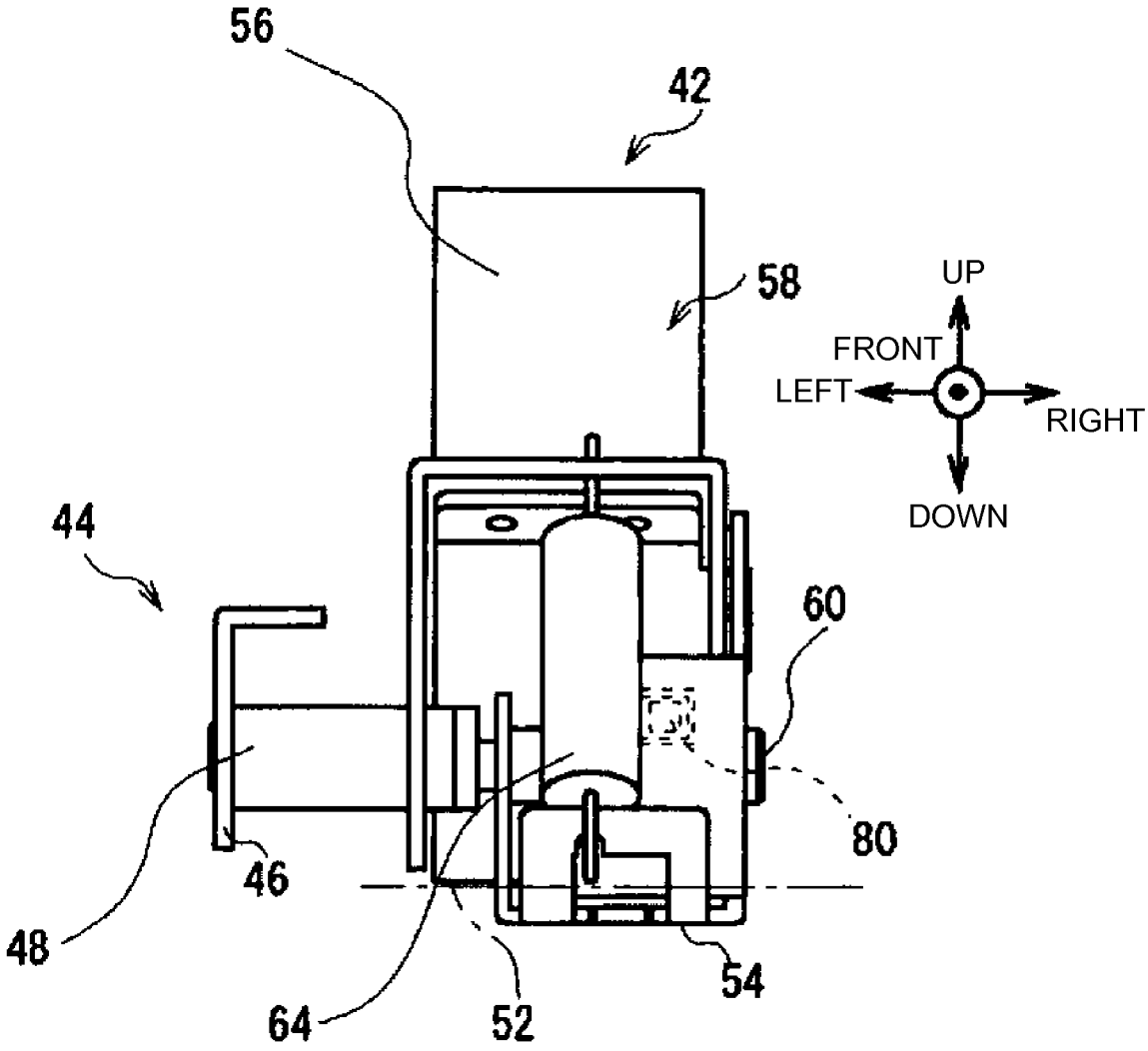
FIG. 6C shows the locked state according to the first embodiment and is a front view.
Figure 19:
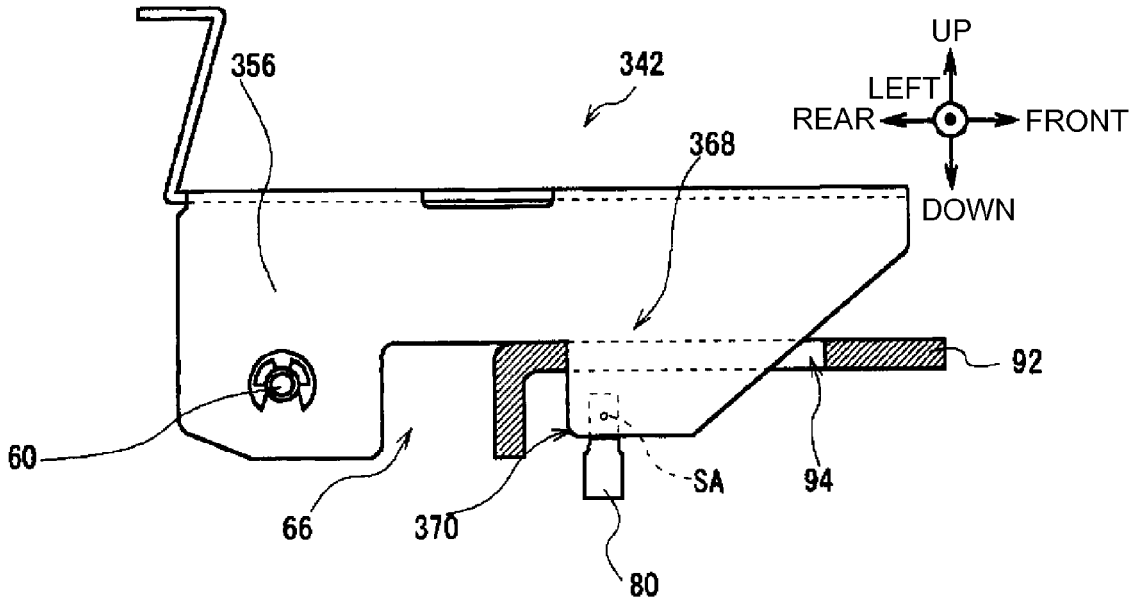
FIG. 19 is a left sectional view showing the locked state according to the fourth embodiment.

In a lock bracket 356 of a lock mechanism 342, compared to the lock bracket 56 (FIG. 6), the lower end portion of the front part of a hook portion 368 is formed along the front-and-rear direction. In FIG. 18 and FIG. 19, the lock base bracket and so forth in the lock mechanism 342 are omitted without being illustrated.

In the pulled-out state (FIG. 18A), a protruding portion 370 is located in a position in which it does not block the sensing area SA of the lock sensor 80. For this reason, the banknote controller 11 detects the light state as shown in FIG. 17.

When the lock bracket 356 moves forward from the pulled-out state, the protruding portion 370 crosses over the rear end part of the lock receiving bracket 92 and becomes hooked into the receiving hole 94, and the lock portion 340 enters the locked state as shown in FIG. 19.

At this time, the protruding portion 370 is positioned in such a way as to block the sensing area SA of the lock sensor 80. For this reason, the banknote controller 11 detects the dark state as shown in FIG. 17.

Figure 20:
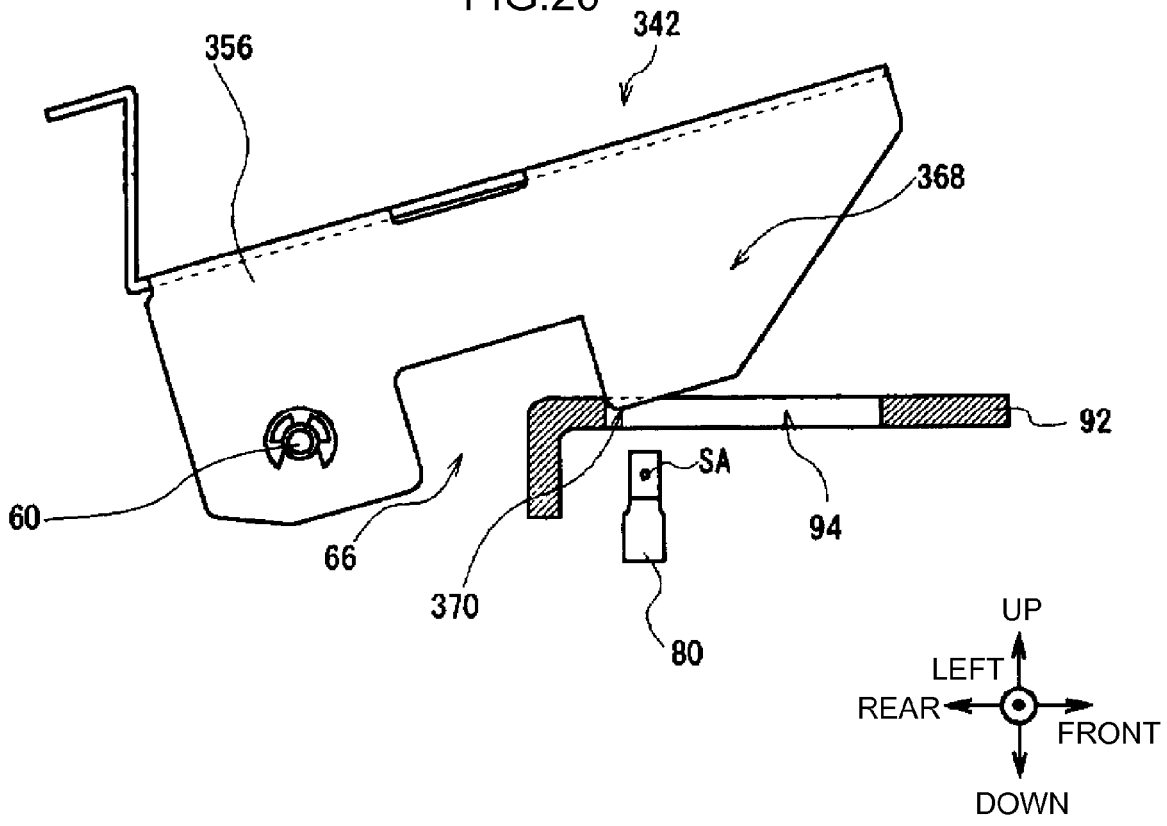
FIG. 20 is a left sectional view showing the half-locked state according to the fourth embodiment.

As shown in FIG. 20, in the half-locked state in which the protruding portion 370 is caught on the rear end of the receiving hole 94, the protruding portion 370 no longer blocks the sensing area SA of the lock sensor 80. At this time, the banknote controller 11 detects the light state as shown in FIG. 17.

In this way, by combining the states of the lock sensor 80 and the states of the interlock switch 38, the banknote deposit and withdrawal machine 310 can detect five states: the locked state, the half-locked state, the pulled-out state, a failure caused by a short circuit, and a failure caused by a disconnection.

Further, in the lock mechanism 342, it is not necessary to dispose the blocking plate 82 like in the lock mechanism 42 (FIG. 6), so the configuration can be simplified.

<5. Other Embodiments>

Figure 21:
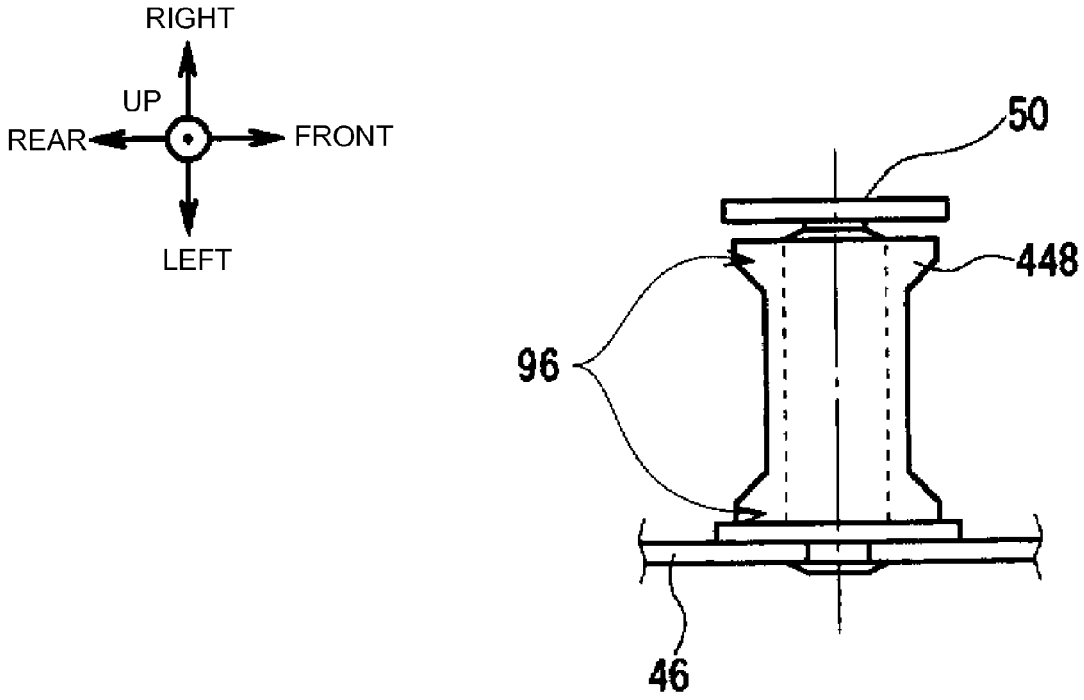
FIG. 21 is a plan view showing a configuration of a lock pin according to another embodiment.
Figure 22:
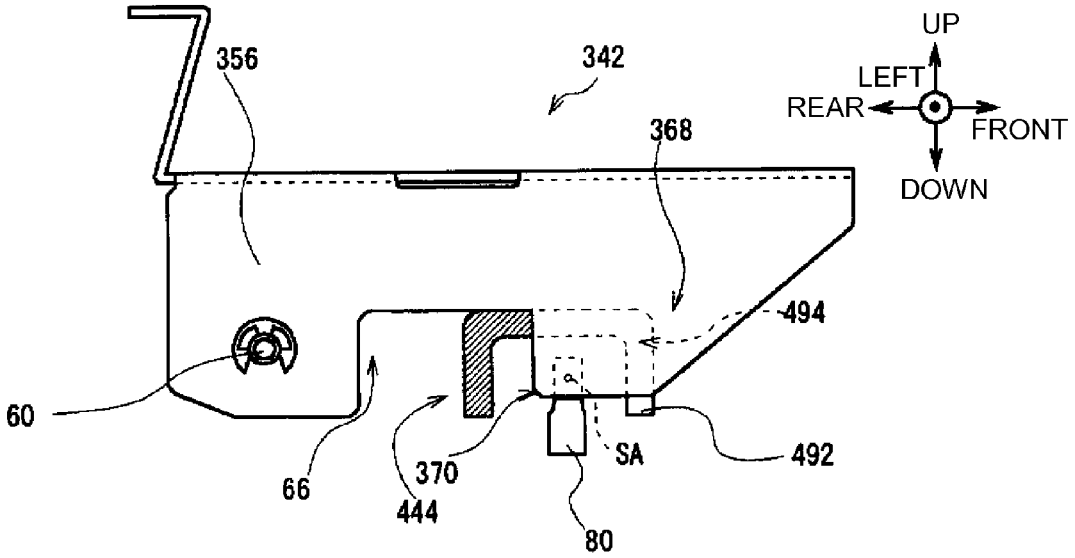
FIG. 22 is a left side surface view showing a locked state of a lock portion according to another embodiment.

In the above embodiments, the lock pin 48 (FIG. 5) whose outer diameter is the same across the right-and-left direction was described. The present invention is not limited to this; like a lock pin 448 shown in FIG. 21, pin flanges 96 whose outer diameters become larger from the central part toward both right and left ends may also be formed.

In this case, even if the lock bracket 56 has become positionally misaligned in the right-and-left direction when the lock bracket 56 hooks onto the lock pin 448, the position of the lock bracket 56 is corrected to the right-and-left direction central part of the lock pin 448 along the outer peripheral surfaces of the pin flanges 96.

The lower unit 28 is extremely weighty, and there is the potential for the cassette frame 30 to become warped because the lower unit 28 is repeatedly pushed into and pulled out from the safe housing 26. For this reason, there is the potential for the position of the lower unit 28 to become misaligned in the right-and-left direction with respect to the safe housing 26.

Even in such cases, the lock pin 448 can prevent right-and-left direction positional misalignment of the lower unit 28 with respect to the safe housing 26 and can further improve positional precision.

Further, even in the case of using a lock receiving bracket like in the fourth embodiment, right-and-left direction positional misalignment of the lower unit 28 may be corrected.

Specifically, as shown in FIG. 22, FIG. 23A, FIG. 23B, and FIG. 23C, a lock receiving bracket 492 of a support portion 444 has a square U shape in which a metal plate extending in the front-and-rear direction is bent in the downward direction at its front and rear end portions, and the lock receiving bracket 492 is fixed to the inside of the safe housing (not illustrated).

Further, a receiving hole 494, which has a substantially rectangular shape and extends from the front-and-rear direction central part of the lock receiving bracket 492 toward the front end portion of the lock receiving bracket 492 as seen in a plan view (FIG. 23C), is formed in the lock receiving bracket 492 in such a way as to penetrate the lock receiving bracket 492 in the up-and-down direction. Moreover, the receiving hole 494 is formed extending to the lower end portion as seen in a front view.

Figure 23A:
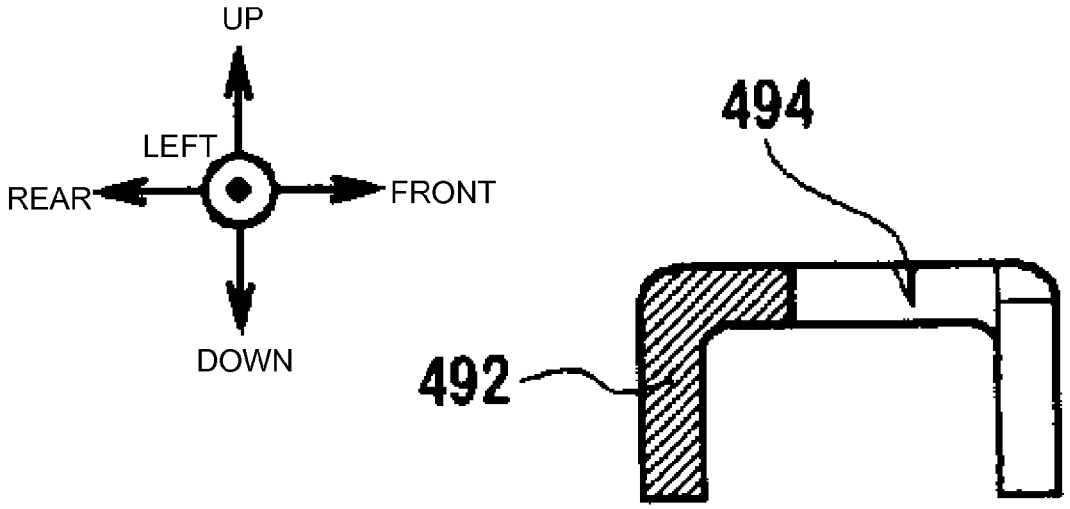
FIG. 23A shows a lock receiving bracket according to still another embodiment and is a left sectional view.
Figure 23B:
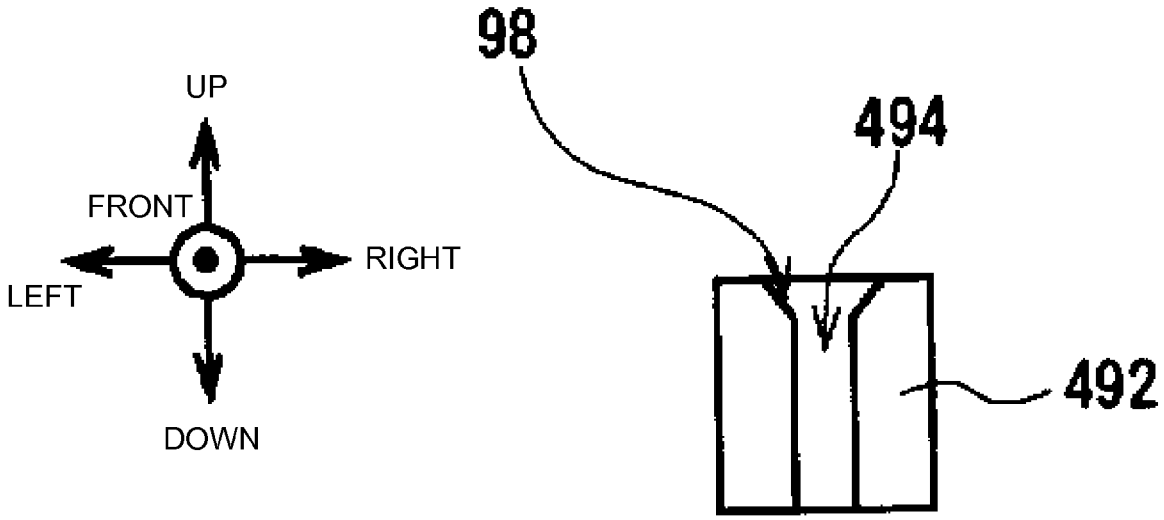
FIG. 23B shows the lock receiving bracket according to the still another embodiment and is a front view.
Figure 23C:
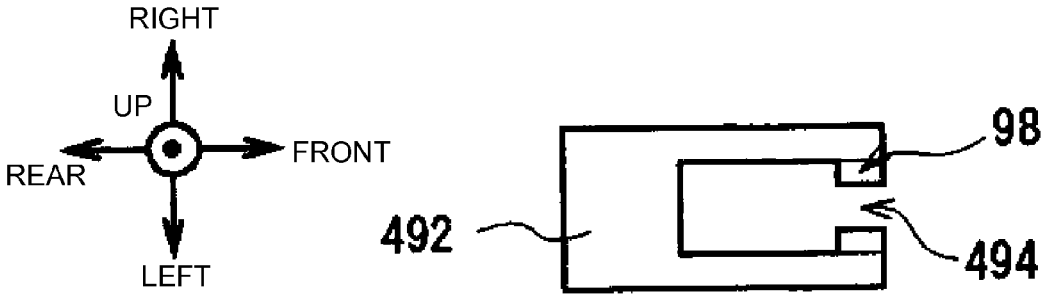
FIG. 23C shows the lock receiving bracket according to the still another embodiment and is a plan view.

As shown in FIG. 23B, a position correcting portion 98, whose right-and-left direction width gradually becomes narrower in a tapered shape from above to below, is formed in the upper portion of the receiving hole 494 as seen in a front view.

In this case, even if the lock bracket 356 has become positionally misaligned in the right-and-left direction when the lock bracket 356 hooks into the receiving hole 494, the position of the lock bracket 356 is corrected to the right-and-left direction central part of the lock receiving bracket 492 along the position correcting portion 98.

Because of this, in the locked state, the hook portion 368 is placed, without becoming positionally misaligned, in the right-and-left direction central part of the sensing area SA of the lock sensor 80 in the locked state.

Because of this, the lock receiving bracket 492 can prevent right-and-left direction positional misalignment of the lower unit 28 with respect to the safe housing 26 and can further improve positional precision.

Moreover, in the above embodiments, a case where the interlock switch 38 is disposed in the safe housing 26 and the projection 36 is disposed on the cassette frame 30 was described, but the present invention is not limited to this; the interlock switch 38 may also be disposed on the cassette frame 30 and the projection 36 may also be disposed in the safe housing 26.

Moreover, in the above embodiments, a case where the present invention is applied when locking the lower unit 28 to the safe housing 26 was described, but the present invention is not limited to this and may also be applied when locking the upper unit 24 to the banknote deposit and withdrawal machine housing 20.

Moreover, in the first embodiment, a case where the lock sensor 80 is disposed on the lock base bracket 54 and the blocking plate 82 is disposed on the lock bracket 56 that moves with respect to the lock base bracket 54 was described, but the present invention is not limited to this; the blocking plate 82 may also be disposed on the lock base bracket 54 and the lock sensor 80 may also be disposed on the lock bracket 56. The same is also true in regard to the second embodiment to the fourth embodiment.

However, it is believed that the lock can be more stably detected when the lock sensor 80 does not move but is fixed and the blocking plate 82 moves.

Moreover, the embodiments may also be appropriately combined, such as combining the fourth embodiment with the first, second, or third embodiment.

Moreover, when locking the lower unit 28 to the safe housing 26, the lower unit 28 may also be locked, and the locked state, the half-locked state, and the pulled-out state may also be detected, by lock portions including various other forms.

Moreover, in the above embodiments, a case where the lower unit 28 is placed in the pulled-out state in which virtually all of the lower unit 28 is pulled out to the outside of the safe housing 26 by moving the lower unit 28 to the rear side of the safe housing 26 was described.

The present invention is not limited to this, and the lower unit 28 may also be placed in the pulled-out state by moving the lower unit 28 to the right side or the left side of the safe housing 26, for example.

Moreover, in the above embodiments, a case where the present invention is applied to the banknote deposit and withdrawal machine in which the lower unit 28 is stored inside the safe housing 26 or is pulled out to the outside of the safe housing 26 was described.

The present invention is not limited to this and may also be applied to the automatic teller machine 1 in which parts such as the banknote deposit and withdrawal machine and a coin processing unit (not illustrated), for example, are stored inside the housing 2 or are exposed to the outside of the housing 2.

Moreover, in the above embodiments, a case where the banknote deposit and withdrawal machine of the automatic teller machine 1, which transacts cash such as banknotes, performs forms of processing such as conveyance processing and storage processing in regard to the banknotes serving as a medium was described.

However, the present invention is not limited to this and may also be applied to various devices that perform forms of processing such as conveyance processing and storage processing in regard to thin, paper-like media such as gift certificates, vouchers, and admission tickets, for example.

Moreover, in the above embodiments, a case where the banknote deposit and withdrawal machine 10 serving as a drawer device is configured by the safe housing 26 serving as a housing, the lower unit 28 serving as a drawer, the interlock switch 38 serving as an interlock switch, the lock portion 40 serving as a lock portion, the lock sensor 80 serving as a lock detection sensor, and the banknote control unit 11 serving as a control unit was described.

However, the present invention is not limited to this, and the drawer device may also be configured by a housing, a drawer, an interlock switch, a lock portion, a lock detection sensor, and a control unit having various other configurations.

Moreover, in the above embodiments, a case where the automatic teller machine 1 serving as a medium transaction device is configured by the safe housing 26 serving as a housing, the customer service unit 3 serving as a reception unit, the upper conveyance path 13 and the lower conveyance path 19 serving as a conveyance unit, the lower unit 28 serving as a drawer, the interlock switch 38 serving as an interlock switch, the lock portion 40 serving as a lock portion, the lock sensor 80 serving as a lock detection sensor, and the banknote control unit 11 serving as a control unit was described.

However, the present invention is not limited to this, and the medium transaction device may also be configured by a housing, a reception unit, a conveyance unit, an interlock switch, a lock portion, a lock detection sensor, and a control unit having various other configurations.

Industrial Applicability

The present invention can be utilized in various devices having a drawer mechanism that executes predetermined processing in a state in which the drawer mechanism is stored in a housing and which is pulled out from the housing to expose part of all of the drawer mechanism when maintenance or other work is performed thereon.

The invention claimed is:

1. A drawer device comprising:

a housing having a predetermined space inside;

a drawer disposed in such a way that it can be stored in a predetermined storage position in the housing and can be pulled out to the outside of the housing;

an interlock switch that detects whether or not the drawer has been pulled out from the housing;

a lock portion that locks the drawer in the storage position and releases a lock to enable the drawer to be pulled out from the housing;

a lock detection sensor that is disposed in the neighborhood of the lock portion and detects at least two states among a locked state in which the lock portion locks the drawer, a half-locked state in which the lock portion incompletely locks the drawer, and a pulled-out state in which the lock of the lock portion is released; and a control unit that distinguishes between the locked state, the half-locked state, and the pulled-out state on the basis of the result of detection by the interlock switch and the result of detection by the lock detection sensor.

2. The drawer device according to claim 1, wherein the control unit determines whether the lock detection sensor has short-circuited or is disconnected on the basis of the output from the lock detection sensor.

3. The drawer device according to claim 1, wherein the lock portion has a support portion that is fixed to the housing and a lock mechanism that is rotatably formed and is hooked to the support portion, wherein the lock detection sensor detects the state of the lock portion on the basis of the position of the lock mechanism with respect to the lock detection sensor.

4. The drawer device according to claim 3, wherein a position correction portion that corrects positional misalignment of the lock mechanism in a direction orthogonal to both a moving direction of the drawer and a moving direction of the lock mechanism is formed on the support portion.

5. The drawer device according to claim 3, wherein the lock detection sensor includes a photointerrupter and detects the state of the lock portion on the basis of whether or not a blocking plate formed integrally with the lock mechanism blocks a sensing area of the lock detection sensor.

6. The drawer device according to claim 5, wherein the blocking plate moves in such a way as to not block the sensing area of the lock detection sensor in the locked state and block the sensing area of the lock detection sensor in the pulled-out state and the half-locked state.

7. The drawer device according to claim 5, wherein the blocking plate moves in such a way as to not block the sensing area of the lock detection sensor in the locked state and the pulled-out state and block the sensing area of the lock detection sensor in the half-locked state.

8. A medium transaction device comprising:

a housing having a predetermined space inside;

a reception unit that is disposed in the housing and receives transactions relating to a medium;

a conveyance unit that is disposed in the housing and conveys the medium received by the reception unit;

a drawer disposed in such a way that it can be stored in a predetermined storage position in the housing and can be pulled out to the outside of the housing;

an interlock switch that detects whether or not the drawer has been pulled out from the housing;

a lock portion that locks the drawer in the storage position and releases a lock to enable the drawer to be pulled out from the housing;

a lock detection sensor that is disposed in the neighborhood of the lock portion and detects at least two states among a locked state in which the lock portion locks the drawer, a half-locked state in which the lock portion incompletely locks the drawer, and a pulled-out state in which the lock of the lock portion is released; and a control unit that distinguishes between the locked state, the half-locked state, and the pulled-out state on the basis of the result of detection by the interlock switch and the result of detection by the lock detection sensor.

* * * * *